US007357616B2

(12) United States Patent
Andrews et al.

(10) Patent No.: US 7,357,616 B2
(45) Date of Patent: Apr. 15, 2008

(54) METHOD AND APPARATUS FOR TRANSPORTING OIL RIG

(75) Inventors: Lloyd E. Andrews, Anchorage, AK (US); Todd A. Driskill, Anchorage, AK (US)

(73) Assignee: Doyon Drilling, Inc., Anchorage, AK (US)

( * ) Notice: Subject to any disclaimer, the term of this patent is extended or adjusted under 35 U.S.C. 154(b) by 504 days.

(21) Appl. No.: 10/769,370

(22) Filed: Jan. 30, 2004

(65) Prior Publication Data

US 2004/0240973 A1 Dec. 2, 2004

Related U.S. Application Data

(60) Provisional application No. 60/443,984, filed on Jan. 30, 2003.

(51) Int. Cl.
*B65G 1/00* (2006.01)

(52) U.S. Cl. ..... 414/332; 414/809; 414/919

(58) Field of Classification Search ..... 414/332, 414/919; 52/118, 122.1, 123.1, 143, 651.1
See application file for complete search history.

(56) References Cited

U.S. PATENT DOCUMENTS 4,021,978 A * 5/1977 Busse et al. ..... 52/118
4,290,495 A * 9/1981 Elliston ..... 175/85
4,368,602 A * 1/1983 Manten ..... 52/115
4,569,168 A * 2/1986 McGovney et al. ..... 52/122.1
4,591,006 A * 5/1986 Hutchison et al. ..... 175/52
4,684,314 A * 8/1987 Luth ..... 414/746.1
6,460,468 B1 * 10/2002 Mobley ..... 105/4.2
6,474,926 B2 * 11/2002 Weiss ..... 414/332
6,634,436 B1 * 10/2003 Desai ..... 173/1
6,860,337 B1 * 3/2005 Orr et al. ..... 173/28
6,974,123 B2 * 12/2005 Latvys ..... 254/122

* cited by examiner

*Primary Examiner*—Saul Rodriguez
*Assistant Examiner*—Joshua I Rudawitz
(74) *Attorney, Agent, or Firm*—Dorsey & Whitney LLP

(57) ABSTRACT

An oil rig capable of being at least partially disassembled to form at least two portions, such as a top half and bottom half, and an associated structure for transport. An oil rig top portion may be loaded onto a trailer for transport separate from a bottom portion. The trailer includes a bottom frame, a top frame, a structure operably associated with said bottom and top frames for moving said top and bottom frames away from and towards one another, and a moving means attached to at least said bottom frame to allow the trailer to be moved along the support surface. The trailer may be towed by a truck or other vehicle.

23 Claims, 20 Drawing Sheets

METHOD AND APPARATUS FOR TRANSPORTING OIL RIG

CROSS-REFERENCE TO RELATED APPLICATIONS

This application claims priority under 35 U.S.C. § 119 to U.S. provisional application Ser. No. 60/443,984, filed Jan. 30, 2003 and entitled "Method and Apparatus for Transporting Oil Rig," which is incorporated by reference herein as if set forth in its entirety.

BACKGROUND

1. Field of the Invention

This invention relates to a method and apparatus for transporting an oil rig, and more particularly to a system and method for partially disassembling an oil rig or other large structure to provide easier transport.

2. Background Art

Oil rigs are huge structures that need to be moved from time to time to accommodate drilling and/or pumping from new oil reserves. Oil rigs are common in many parts of the world, including the Middle East, Siberia, and Alaska. Although the structure of an oil rig may vary somewhat depending on the terrain in which the rig is placed or over which it travels, the general rig structure and function remain the same.

Typically, and especially on the North Slope of Alaska, each oil rig includes a rig substructure upon which a rig floor and mast are positioned. The rig substructure is often self-motile, permitting it to be driven from one drilling site to another. With respect to such oil rigs, a rig floor and mast are typically attached to the top of the rig substructure. Thus, the entire oil rig may be transported, as necessary, under its own power.

Generally, oil rigs are massive structures. A typical oil rig weighs over two million pounds and is approximately 100 feet tall. Thus, the travel speed of a self-powered rig is rather limited, and adverse terrain may considerably slow the rig (if not prevent travel completely). For example, it is extremely difficult to transport a self-motile across tundra, due to the uneven surface and snow, as well as the challenges posed by rivers, crevasses, or other discontinuities in the tundra surface.

On the North Slope, an ice-road is typically built to move oil rigs over tundra in order avoid building a permanent road, which may create a relatively heavy environmental impact. Unfortunately, ice roads are comparatively expensive to build, and take a great deal of time to complete. In addition, when moving an entire rig by driving the substructure, the ice road has to be a certain thickness to accommodate the two million pound vehicle. Further complications arise when bridges must be built to traverse a river or other wet area. Although typically temporary, a bridge fashioned of solid ice and capable of supporting a two-million pound vehicle is a complex and expensive proposition.

Accordingly, there is a need in the art for an improved method and apparatus for transporting an oil rig.

SUMMARY OF THE INVENTION

Generally, the present invention takes the form of an oil rig capable of being at least partially disassembled to form at least two portions, such as a top half and bottom half, as well as an associated structure or structures for transporting the oil rig portions. The top portion of the oil rig may be loaded onto a trailer for transport separate from the bottom portion. In one embodiment, the aforementioned trailer includes a bottom frame, a top frame, a structure operably associated with said bottom and top frames for moving said top and bottom frames away from and towards one another, and a moving means attached to at least said bottom frame to allow the trailer to be moved along the support surface. The trailer may be towed by a truck or other vehicle.

The invention may also take the form of a method for transporting an oil rig, in the steps of disassembling the oil rig to form a top portion and bottom portion, and transporting the top portion separately from the bottom portion. The top portion typically includes a rig floor and mast, while the bottom portion includes a substructure. The rig floor and mast may be loaded onto a trailer for transport separate from the substructure.

These and other features and advantages of the present invention will be apparent to those skilled in the art upon reading the entirety of the disclosure.

DETAILED DESCRIPTION OF THE INVENTION

Overview of the Present Embodiment

Figure 2:
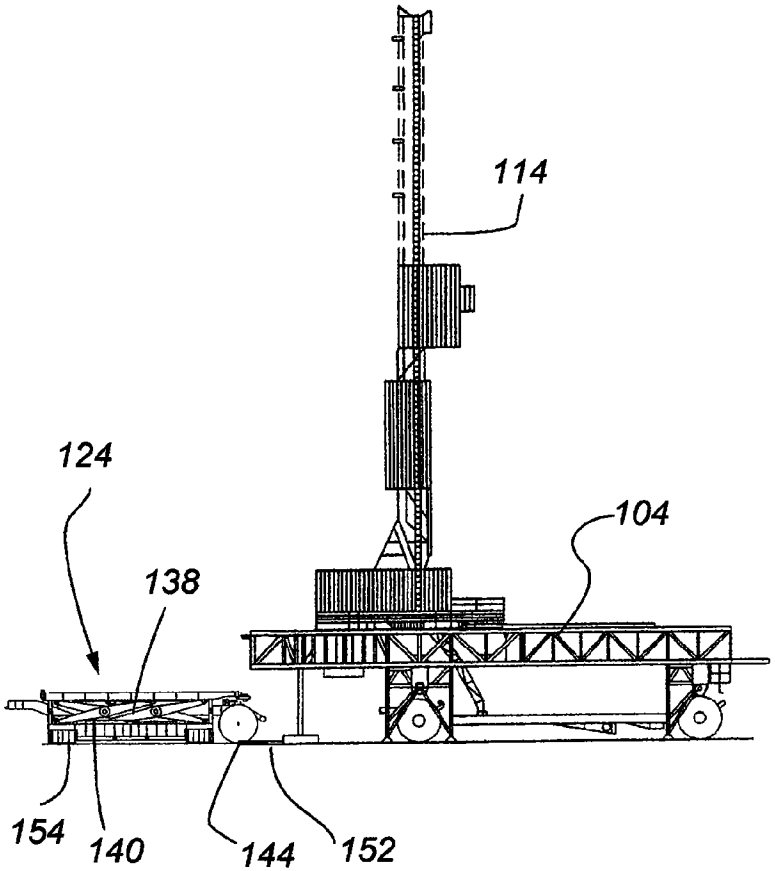
FIG. 2 depicts side view of the oil rig and trailer, with the trailer in a collapsed position.

Generally, one embodiment of the present invention takes the form of a method and apparatus for transporting an oil rig. An oil rig is configured to be disassembled into two separate pieces, namely a top and bottom half. The top half of the oil rig typically includes a rig floor and mast, while the bottom half includes a substructure for the oil rig and associated components. In the present embodiment, weight is split relatively evenly between these two elements, with each weighing approximately one million pounds. In alternate embodiments, the oil rig may be split differently (for example, with the rig floor remaining attached to the substructure), or the weight of the rig may be divided differently between the two separate pieces. In yet other embodiments, the rig may be separated into three or more pieces. For example, the mast may be decoupled from the rig floor, which in turn may be detached from the rig substructure. Accordingly, the terms "top portion" and "bottom portion" are used interchangeably herein with "top half" and "bottom half," respectively, to indicate the oil rig may be split into multiple portions or portions of uneven size or weight distribution.

Once decoupled, the top half or section (i.e., the mast and rig floor) may be attached via a jeep-and-gooseneck arrangement to one or more trucks for towing to a new rig site. The tucks may be connected side-by-side (i.e., in parallel) or one after the other (i.e., in series) to a towing structure for the top half, generally referred to herein as a "rig floor trailer." The rig floor trailer generally accepts and supports the rig floor and mast for towing by the truck(s).

While the top half (i.e., rig floor and mast) are towed by one or more trucks, the substructure and related components are self-motile. Accordingly, the substructure may be moved under its own power to the new oil rig site.

Because the top and bottom sections each weigh approximately one half the weight of the entire oil rig, any ice road or ice bridge created to support the oil rig during travel need not be as thick as would be required if the oil rig were not disassembled. For example, the entire rig structure weighs approximately two million pounds. Accordingly, an ice bridge or road must support two million pounds or more, without cracking or breaking, in order to provide transport for a conventional or fully-assembled oil rig. By contrast, with the present invention, an ice road or bridge need only support one million pounds, because the top and bottom halves may be transported separately and far enough apart from one another that a single section of ice road need not support the entire weight of the rig at once. Accordingly, where ice roads or ice bridges must be created to facilitate oil rig transport, they need be fractionally as thick as ice roads or bridges necessary to move a conventional oil rig. This, in turn, represents a significant monetary and labor savings in the construction of ice structures.

Once both sections are at the new site, the top half of the present invention may be removed from the truck and trailer. The top half may be settled back on the rig substructure and affixed in place to reassemble the oil rig. Once reassembled, the oil rig may be used as desired.

It should be noted that, while reference is often made only to one figure or photograph, in many cases at least one other figure or photograph may show the same detail, or greater detail of the component or feature being described. Further, oil rig platforms can either implement derrick structures or mast structures. While this invention is described for use on mast-type oil rigs, it is contemplated that it can also be used with derrick-type oil rigs with the proper modifications.

The Oil Rig Substructure

Figure 1:
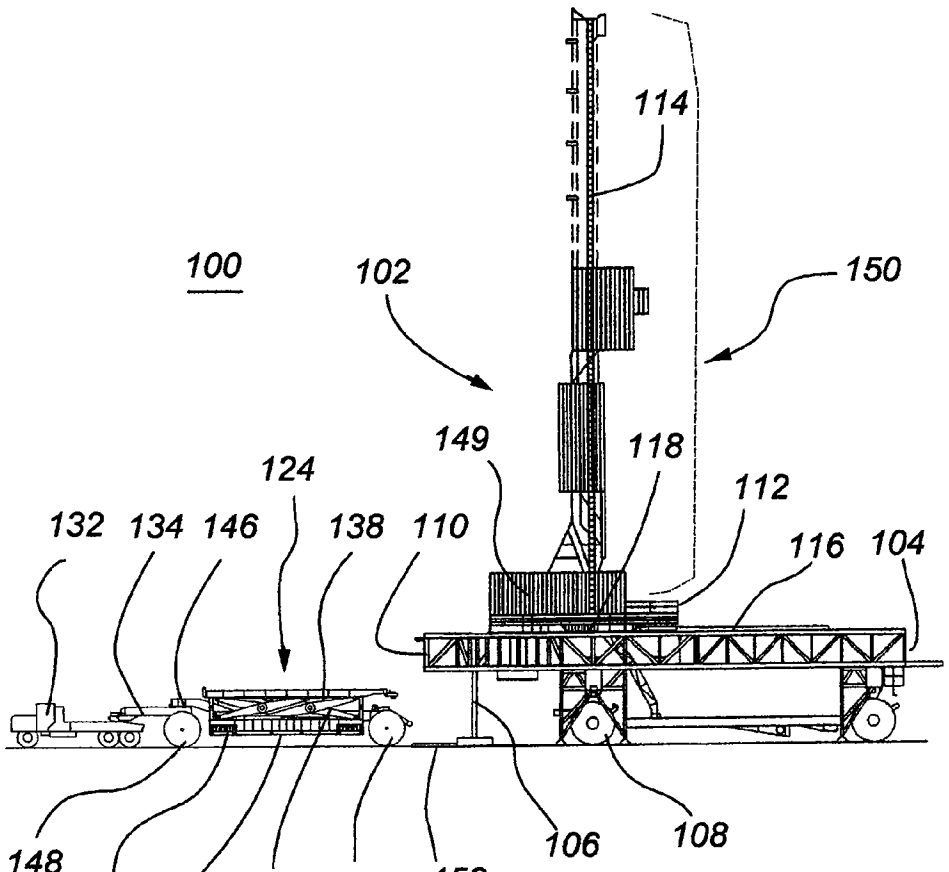
FIG. 1 depicts one embodiment of the present invention, namely a separable oil rig and associated trailer.

FIG. 1 shows an oil rig 102 with a portion of the present invention 100 (namely, the floor and mast trailer 124, or simply "trailer") positioned nearby and ready for utilization. The oil rig, as described above, includes a substructure 104, which in this case is a wheeled, self-powered, frame structure. The substructure is shown as a frame-work, but is typically enclosed when in use (i.e., deployed in the field). Equipment, motors, pipe and supplies (not shown) are typically encompassed and built into the substructure 104, when the substructure is in use. Retractable bracing 106 is included to transfer the load of the rig 102 through the substructure 104 and to the ground, instead of placing the load on the substructure's wheels 108 and axles when the substructure is in a stationary position. The substructure typically includes a cantilever portion 110 extending from one end. The top of the cantilever portion 110 is flush with the top surface of the rest of the substructure 104, and the bottom of the cantilever portion is raised off the ground, terminating at approximately one-half the height of the substructure above ground level.

The Rig Floor and Mast

A rig floor 112 and mast 114 are situated atop the substructure 104. The rig floor 112 is effectively a framework that sits on top of the substructure and is attached thereto. The rig floor may have walls and a ceiling making up a weather enclosure 149. Some embodiments may omit the weather enclosure. When present, the weather enclosure 149 generally surrounds the primary equipment found on the rig floor 112. "Primary equipment" may include pumps, winches, motors, controllers, and so forth. (Note that the primary equipment is obscured from view in FIG. 1 by the enclosure.)

The mast 114 is attached to the rig floor 112. When the rig floor is released or otherwise detached from the substructure 104, the mast typically remains connected to the rig floor. As previously mentioned, some alternate embodiments may permit the mast 114 to be detached from the rig floor 112 to facilitate transport. The rig floor is movable on the top surface of the substructure along a rail system 116, as is commonly known in the art. The rig floor 112 and mast 114 can be moved relative to the substructure 104 and along the rail system 116 by use of a winch or press (not shown), which pushes and/or pulls the rig floor and mast to the desired position.

The mast 114 extends upwardly from the rig floor 112. It is attached to the rig floor in a manner that permits partial disconnection from the rig floor, as well as downward pivoting towards the front and/or back of the rig floor 112 (i.e., to the right or left, relative to FIG. 1). Generally, the mast 114 pivots about the connection 118 with the rig floor 112. Draw works (cables, pulleys, winches, drive motors and controllers and the like) are operably attached between the mast 114 and the rig floor 112 to control the pivoting of the mast. The mast can be pivoted downwardly to extend effectively parallel to the ground, or at right angles to its vertical position.

Disassembling and Transporting the Oil Rig

Figure 20:
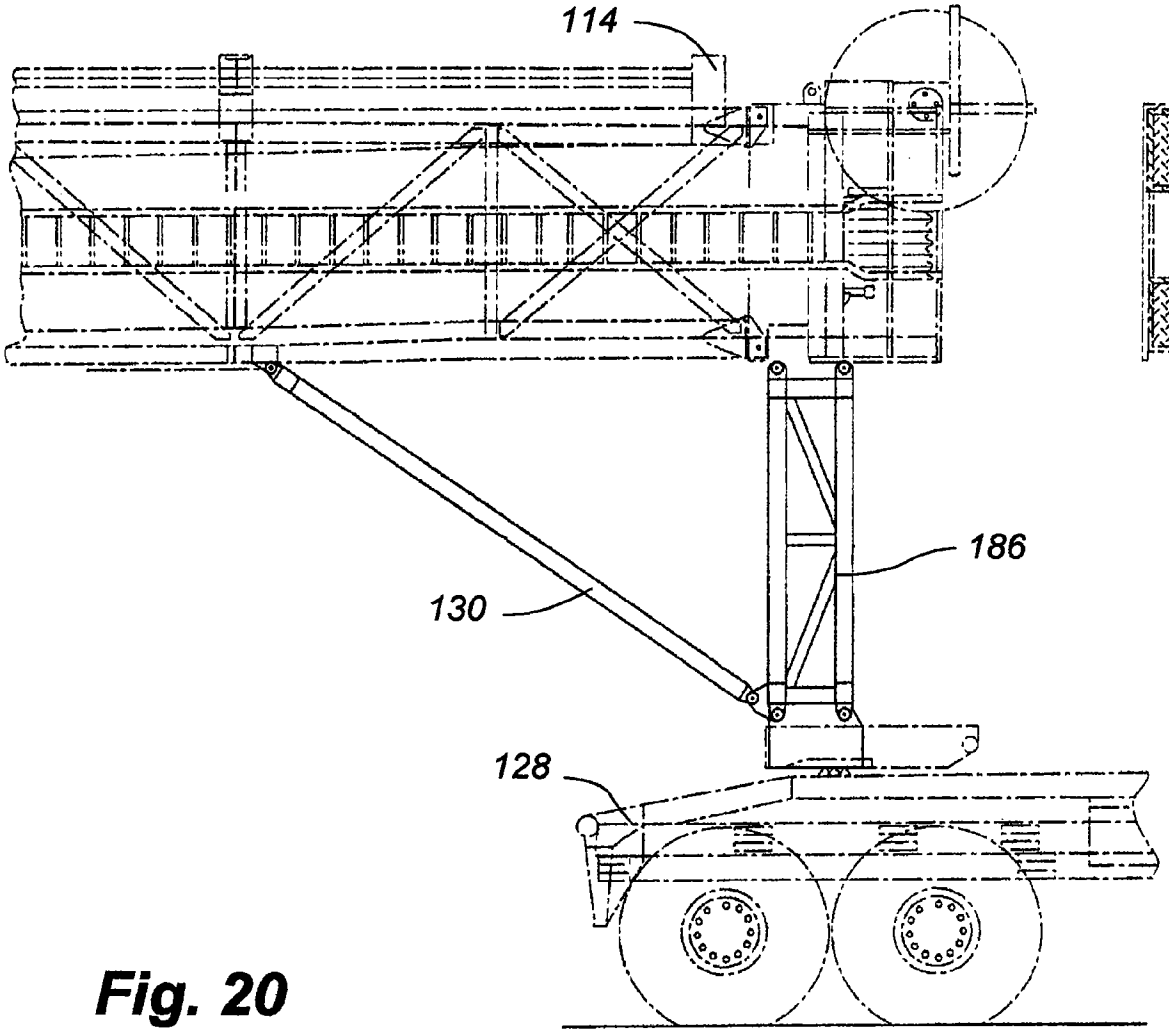
FIG. 20 depicts a side view of a mast dolly kingpin and mast support, for use with the mast dolly of FIG. 16.

The trailer system of the present invention includes a rig floor trailer 124, a mast dolly 128 and a mast dolly kingpin 130. (The mast dolly is shown to better effect in FIGS. 16-19, while the mast dolly kingpin is depicted in FIG. 20). The trailer 124 may be used alone, or with other elements of the trailer system, such as the truck 132 depicted in FIG. 1. Similarly, the mast dolly 128 and mast dolly kingpin 130 may also be used separately from the trailer 124 if desired, as described below.

FIG. 1 shows the rig floor trailer 124 attached to a truck 132 by two side-by-side load-divider jeeps 134, only one of which is shown in side view. The rig floor trailer includes a bottom frame 136, a top frame 138 and a set of scissor jacks 140 positioned between the bottom and top frames. The scissor jacks 140 may selectively move to place the trailer 124 in a retracted, or lowered, position as shown in FIG. 1. When in the retracted position, the top frame 138 is relatively close to the lower, or bottom frame 136.

Figure 4:
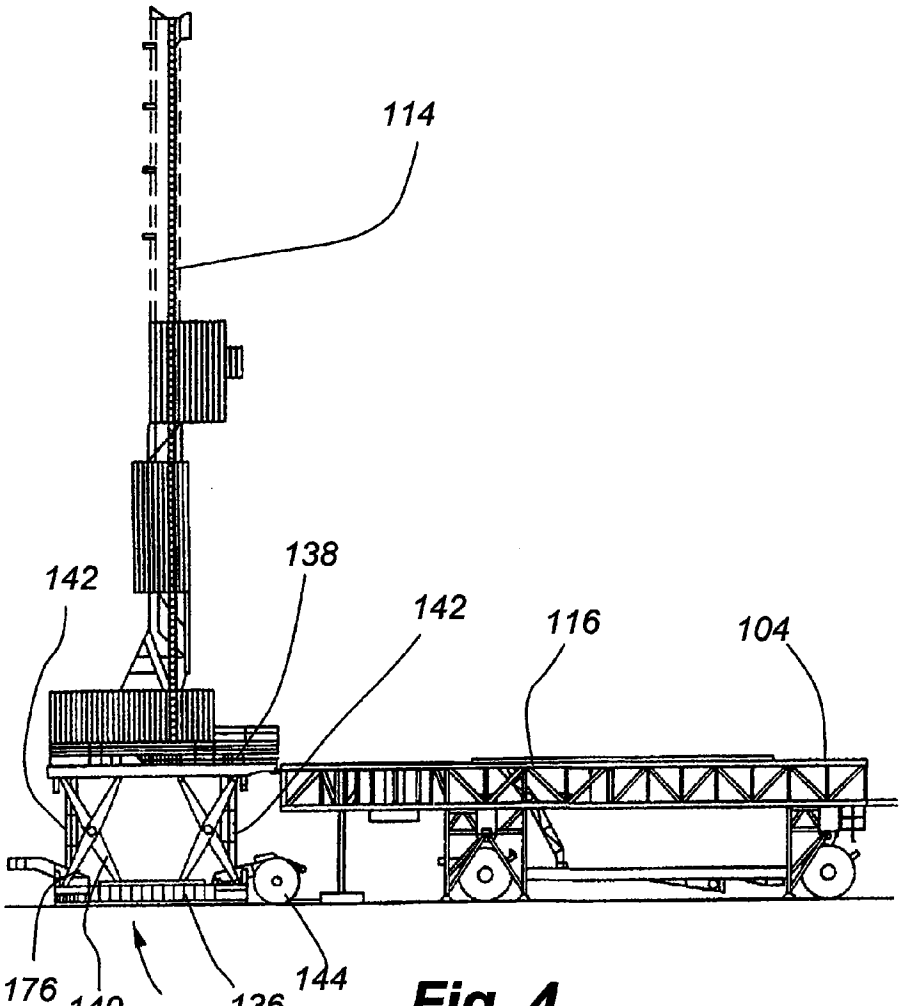
FIG. 4 depicts a side view of a rig floor and mast placed on the top surface of the trailer of FIG. 1.
Figure 3:
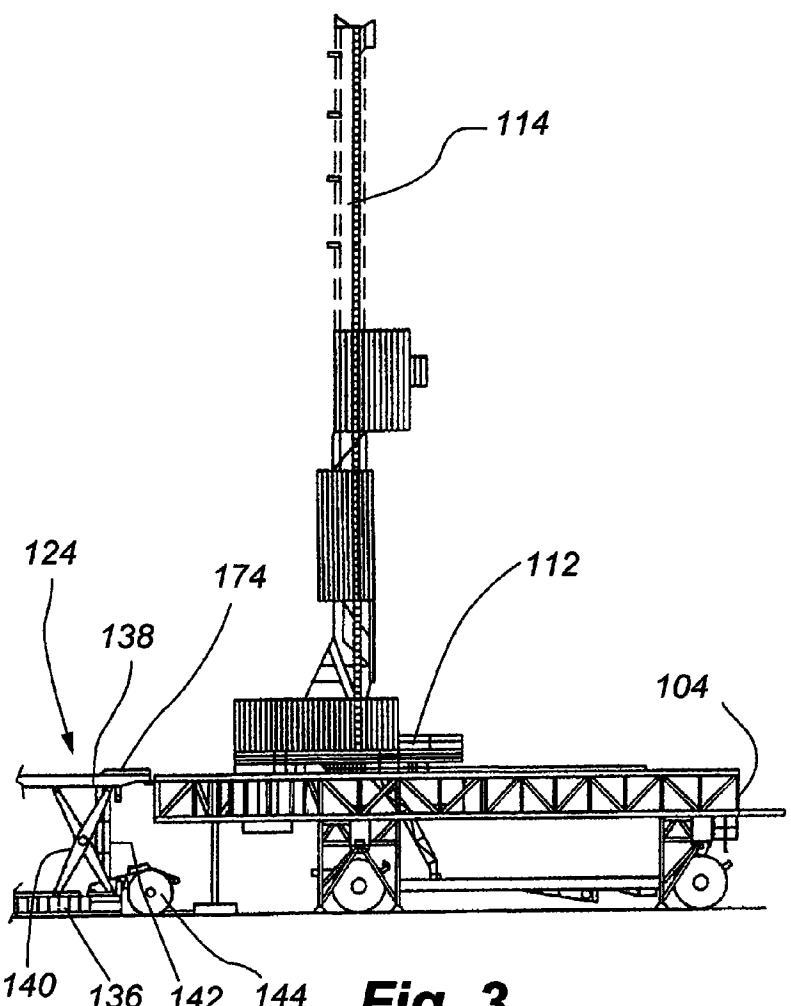
FIG. 3 depicts a side view of the oil rig and trailer of FIG. 1, with the trailer partially shown in an extended position.
Figure 30:
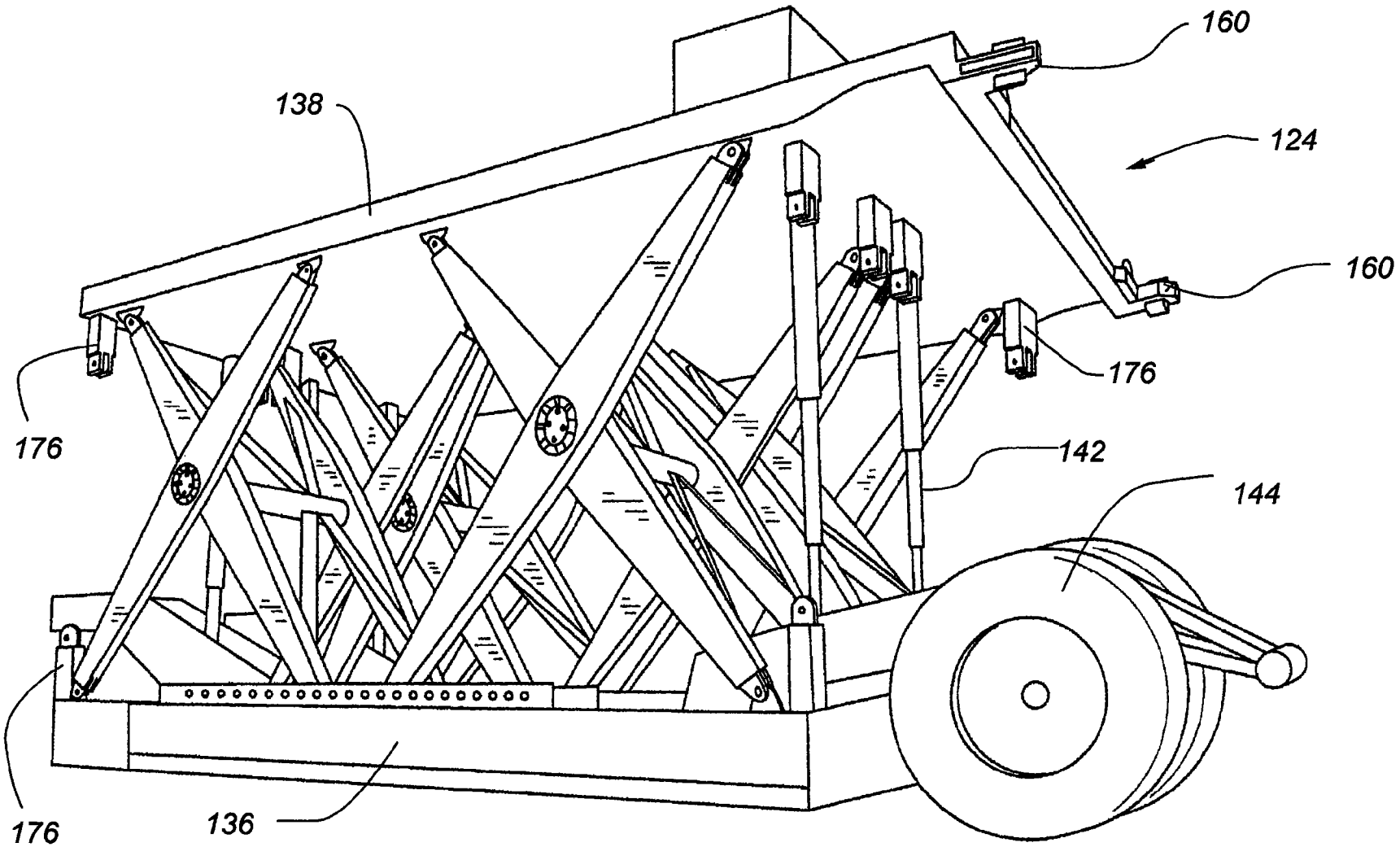
FIG. 30 depicts a perspective view of the trailer of FIGS. 12-13 and 29, in an extended position.

Similarly, the scissor jacks 140 may extend to place the trailer 124 in an upper, or extended, position as shown in FIGS. 3 and 4. In this position, the trailer's top frame 138 is spaced away from the lower frame 136. The top frame is moved relative to the lower frame by hydraulic cylinders or pistons 142. Movement between the extended and lowered positions is controlled and supported by the scissor jacks 140, which can be pinned or otherwise arrested in a variety of positions. Exemplary immobile positions for the scissor jacks 140 include the aforementioned lowered and extended positions, as well as many positions in between. Pinning of the jacks 140 is described in greater detail later. (For reference, FIG. 30 depicts the scissor jacks 140 and pistons 142 in detail.)

Generally, pinning the jacks 140 in position allows the load on the top frame 138 of the trailer 124 to be carried by the scissor jacks, rather than the hydraulic pistons 142. In the instant embodiment 100, eight sets of scissor jacks 140 and four hydraulic pistons 142, along with associated pumps, motors and controllers, are used. Alternate embodiments may use more or fewer jacks, pistons, pumps, and so forth.

Returning to FIG. 1, a plurality of wheels 144 mounted on separate or a common axle are attached to the trailer 124 for support. The axle(s) for the wheels 144 may pivot out of the way to allow the bottom frame 136 to rest on the ground, as described in more detail below (and shown in FIG. 3). Still with respect to FIG. 1, at the end of the trailer 124 opposite the wheels 144, at least one gooseneck 146 is attached to selectively connect the jeep 134 to the truck 132. Generally, one gooseneck 146 per jeep 134 is used, although alternate embodiments may employ multiple goosenecks per jeep, or a single gooseneck for multiple jeeps. The jeep 134 includes a set of wheels 148 such that, when the jeep is attached to the trailer 124, the trailer end opposite the pivotable wheels 144 is adequately supported. In alternate embodiments, each jeep 134 may include a retractable support bar or skid plate in place of (or in addition to) wheels 148. Both a jeep 134 and/or the trailer 124 may employ a single wheel in lieu of multiple wheels.

Although the present embodiment 100 makes reference to a wheel 144 or wheels affixed to the trailer 124 to facilitate transport of a portion of the oil rig 102, alternate embodiments may use transport surfaces other than wheels. For example, an alternate embodiment might employ a track to facilitate transport across sand or a shifting surface. Another embodiment might employ a skid surface, such as a ski, to facilitate transport across ice or other slick surfaces. Yet another embodiment might employ railroad wheels to facilitate transport across a railroad. Similarly, although the present embodiment generally describes a truck 132 or towing the trailer 124, alternate embodiments may employ a rail car, locomotive, tank, or any other vehicle sufficient to move the trailer from a first to a second point.

The front end of each jeep 134 is configured to hitch to a truck 132, permitting multiple trucks arranged side-by-side to pull the trailer. Alternately, the trucks 132 can be arranged end-to-end (for example, when the road is narrow) with the use of a tow-bar hooked between ends of adjacent jeeps 134, which allows multiple jeeps to be commonly attached to a single truck.

The method for positioning the top portion 150 of the oil rig 102 (i.e., mast 114 and rig floor 112) on the trailer 124 will now be described. First, the trailer 124 is positioned near the substructure 104, for example near the cantilever end 100. The end of the trailer's top frame 138 is typically aligned with the cantilever end 100 of the substructure's 104 top surface, such that a positioning device 152 may be placed on the ground. This is shown to good effect in FIG. 1. The positioning device 152 generally creates a block against which the pivotable wheels 144 of the trailer 124 may impact when the trailer is properly positioned with the substructure 104. In other words, the positioning device both provides feedback to the person positioning the trailer relative to the substructure, and also at least partially prevents the trailer from being placed too close to (or far from) the substructure, thus facilitating proper alignment between components. For example, FIG. 2 depicts the trailer's 124 wheels 144 engaging the positioning device 152. It should also be noted the positioning device 152 can be adjusted to facilitate positioning the trailer 124 with various types or configurations of substructures 104.

Figure 5:
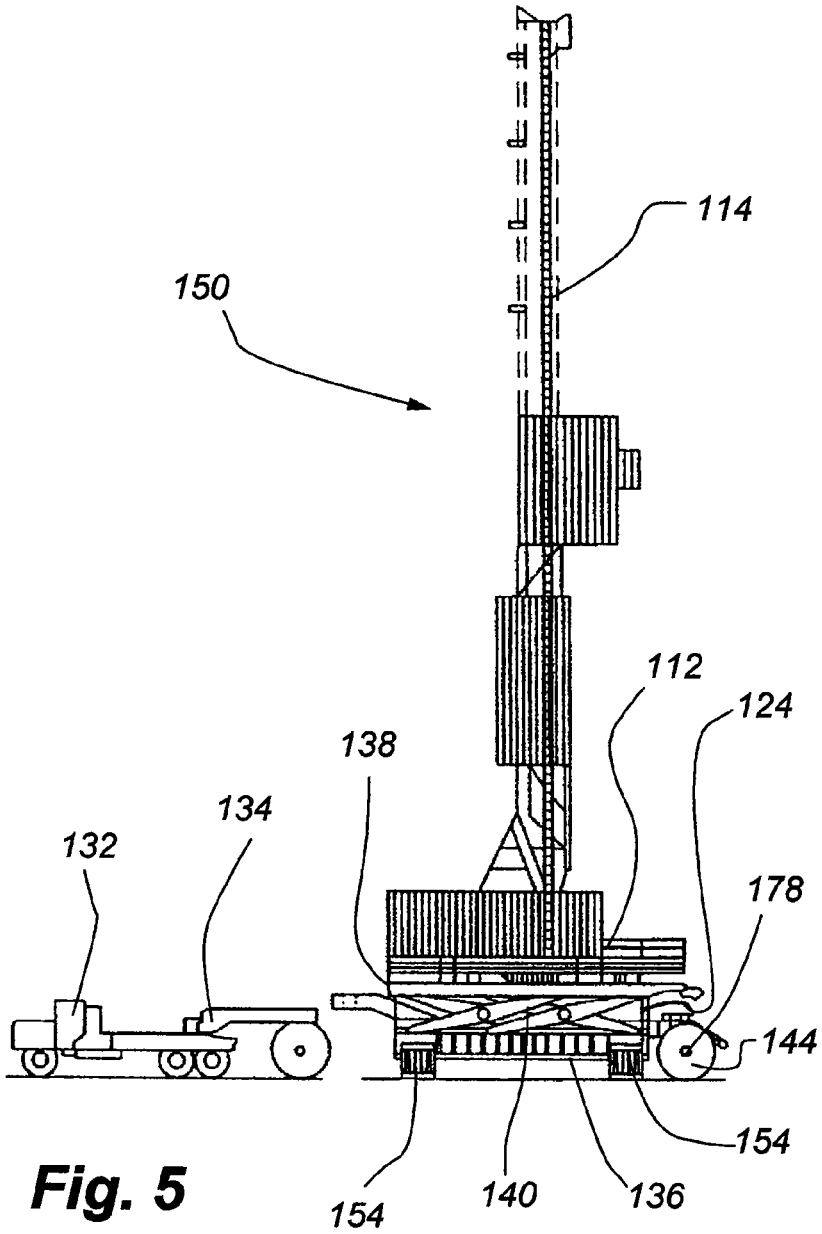
FIG. 5 depicts a side view of the trailer of FIG. 1 in the collapsed position, with the rig floor and mast) positioned thereon.

Once the trailer 124 is properly positioned, retractable feet 154 may extend at each end from the bottom of the trailer's bottom frame 136 for support. This is shown to better effect in FIG. 15, although the feet are visible in FIGS. 1 and 2. The pivotable wheels 144 are then disconnected from their drive position and allowed to pivot so the lower frame 136 and entire trailer 124 move toward the ground, at which point the jeeps 134 are disconnected from the trailer. At this point, the feet 154 essentially accept the trailer weight. FIG. 5, for example, depicts the retractable feet 154 in an extended position, while FIG. 2 depicts the feet in a retracted position.

Figure 29:
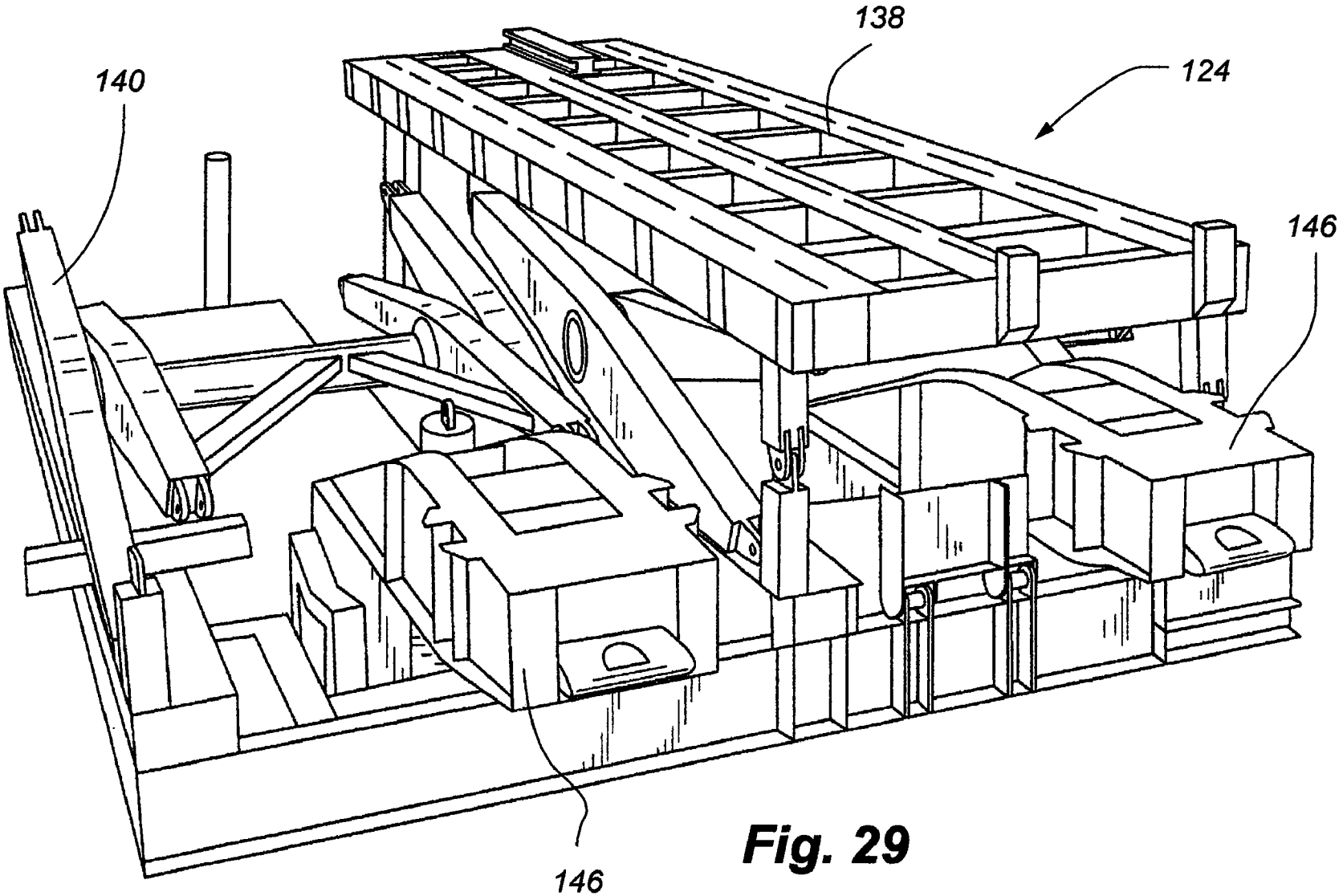
FIG. 29 depicts a perspective view of the trailer of FIGS. 12-13, with a portion of the top surface removed.

Still with respect to FIG. 2, once the wheels 144 and the jeeps 134 are removed, the retractable feet 154 retract to allow the trailer 124 to lie directly on the ground. The trailer and/or feet may be shimmed, as necessary, to ensure the top surface 138 of the trailer is generally parallel with the upper plane of the substructure 104. The hydraulic pistons 142 are then actuated to raise the trailer 124 from the lower position (shown in FIG. 2) to the upper position (shown in FIG. 3). It should be noted the pistons 142 may be only partially actuated, insofar as the object is to place the trailer's top surface 138 at a height equal to the top of the substructure 104. The scissor jacks 140 are at least partially extended to place the trailer in the aforementioned position. For reference, FIG. 29 depicts the trailer 124 in an extended position, with a portion of the top surface 138 and one scissor jack 140 removed to show details of the remaining scissor jacks and connecting goosenecks 146. As shown in FIG. 29, the top surface 138 may be formed of crossbars or otherwise have holes extending therethrough. In alternate embodiments, such as the one shown in FIG. 30, the top surface may be solid.

Figure 22:
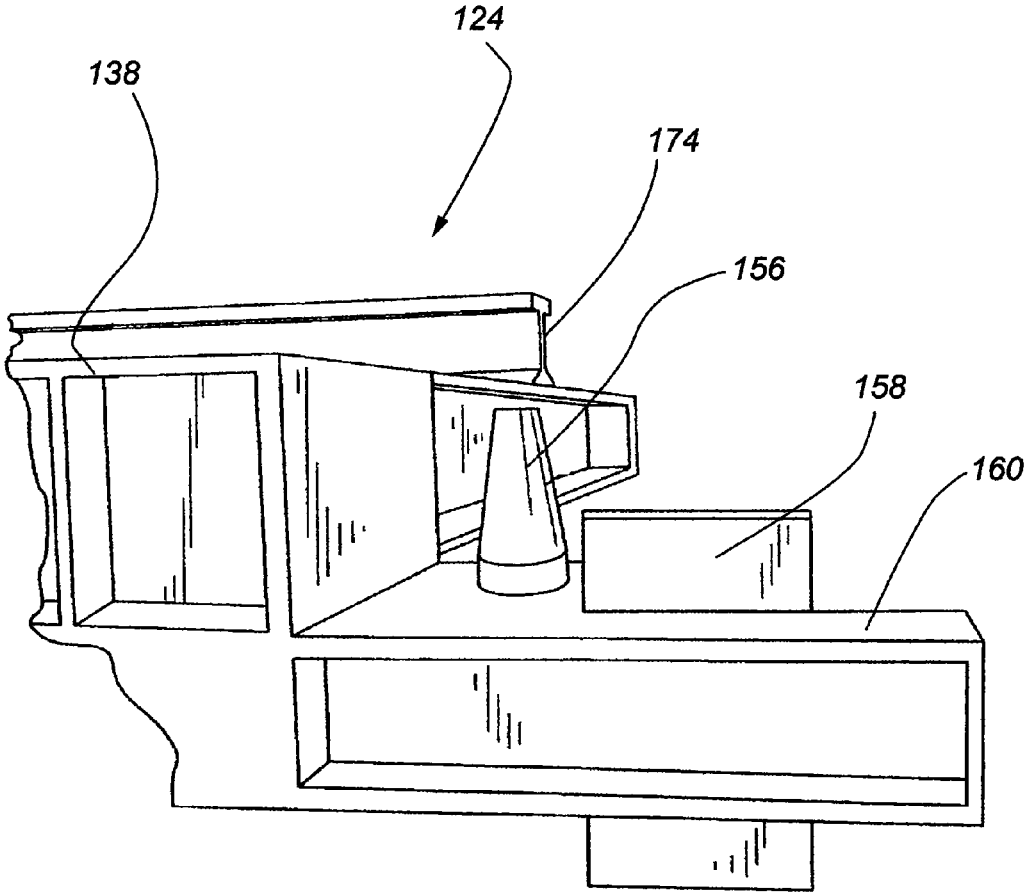
FIG. 22 depicts a conical member and beam guide.
Figure 23:
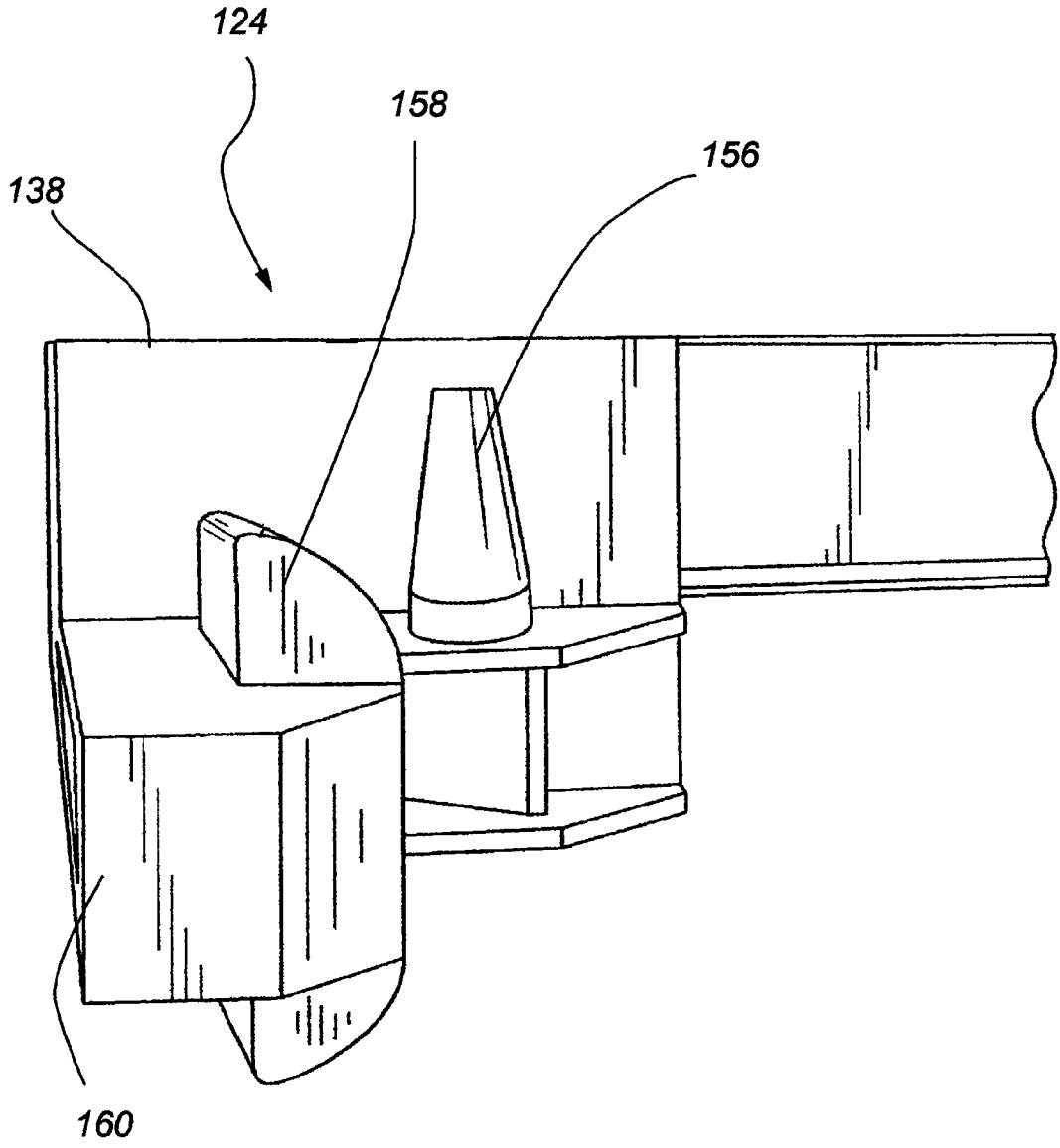
FIG. 23 depicts an end view of the conical member and beam guide of FIG. 22.

Returning to FIG. 3, the end of the top portion 138 of the trailer 124 generally engages the substructure 104. Two alignment features ensure a sufficient structural connection between the top of the trailer and the substructure. Specifically, a conical member 156 and a beam guide 158 are positioned at either outside edge of the end of the top portion 138 of the trailer 124. The conical member 156 and beam guide 158 are shown, for example, in FIG. 22, and their operation is hereby described. The conical member 156 extends upwardly from the trailer top surface 138 to fit into a recess formed in the base of the substructure's top surface 138. The beam guide 158 engages the inside edge of a beam on the underside of the substructure's top surface, and facilitates proper alignment between the trailer 124 and substructure 104. The beam guide further provides a structural interconnection, and supports sliding the rig floor 112 and mast 114 from the substructure onto the trailer. In short, the combination of conical member 156 and beam guide 158 facilitate proper alignment between trailer 124 and substructure 104, which eases movement of the rig floor 112 and mast 114 from the substructure onto the trailer. For example, FIG. 22 depicts a front view of both the conical member 156 and beam guide 158 jutting upward from the trailer's top surface 138. (It should be noted that the top surface of the trailer is shown in partial, fragmentary view. Further, alternate embodiments of the trailer may differ in detail from the embodiment shown in FIG. 22.) As can be seen in FIG. 22, the beam guide 158 generally is positioned on a protrusion 160 extending outwardly from the trailer, and the conical member 156 is offset both laterally and longitudinally from the beam guide. Further, the top of the conical member extends beyond the top of the beam guide. In alternate embodiments, some or all of these configuration parameters may change. For example, the conical member's 156 top may be lower than the beam guide's top 158. Similarly, in some embodiments the conical and beam guides may be laterally and/or longitudinally aligned. FIG. 23 depicts an end view of the conical member 156 and beam guide 158, showing their placement with the top of the conical member generally below the top surface 138 of the trailer 124.

Figure 24:
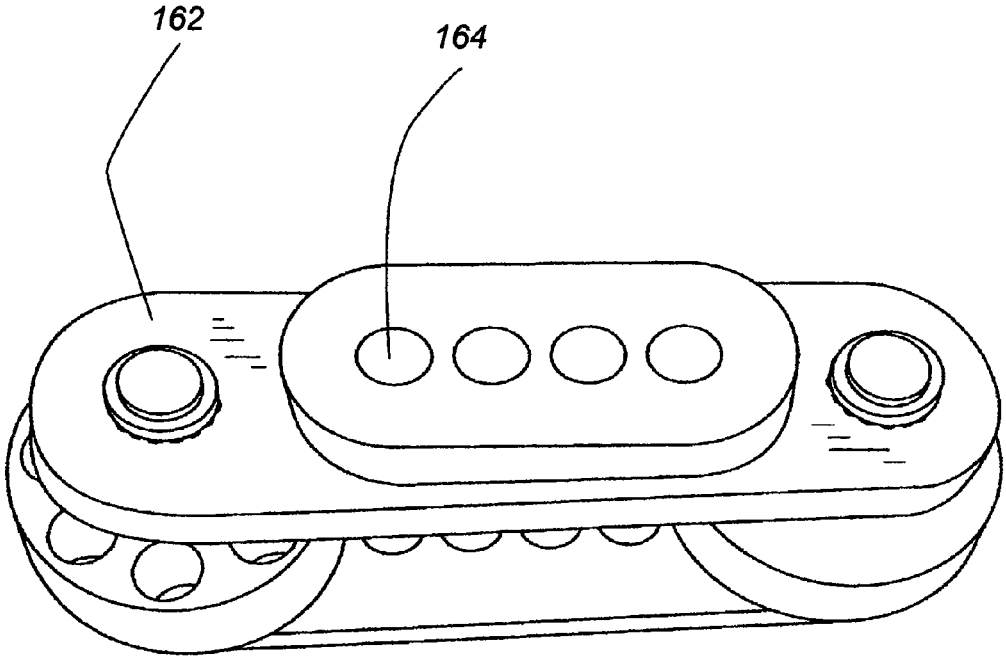
FIG. 24 depicts side links for use at a free end of a scissor jack.
Figure 25:
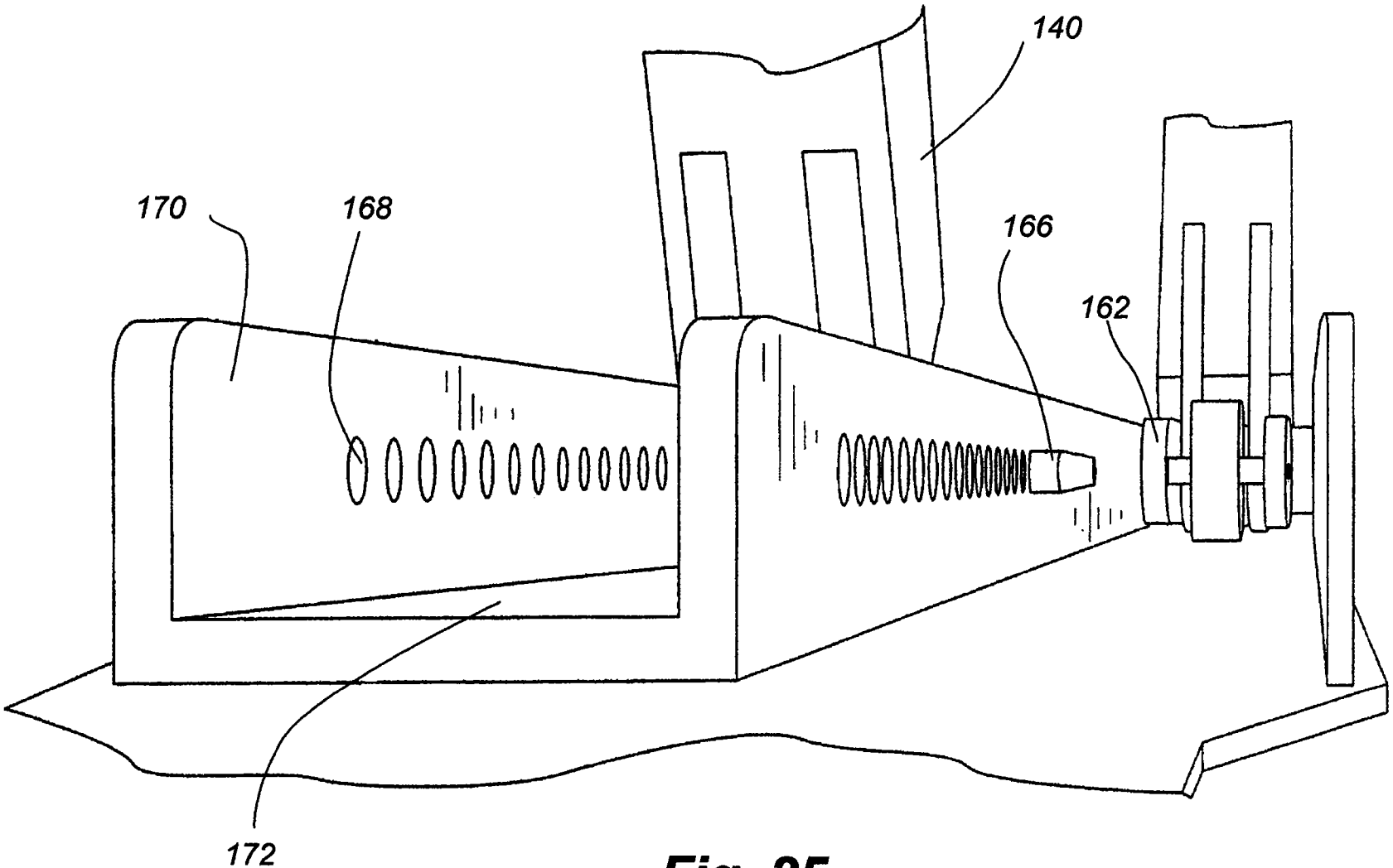
FIG. 25 depicts a pin extending through a positioning hole in a rail and track occupied by a scissor jack.
Figure 27:
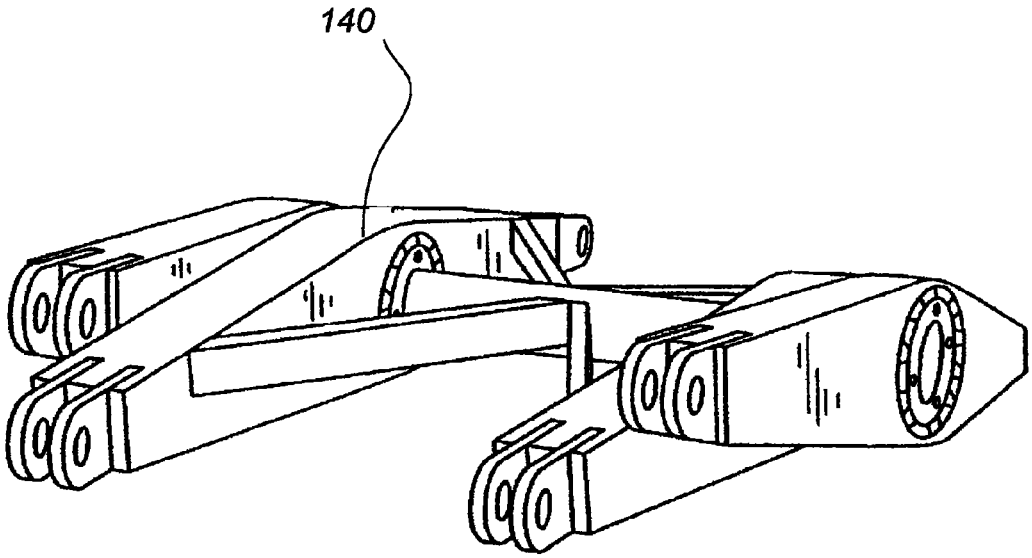
FIG. 27 depicts a perspective view of a closed scissor jack.
Figure 28:
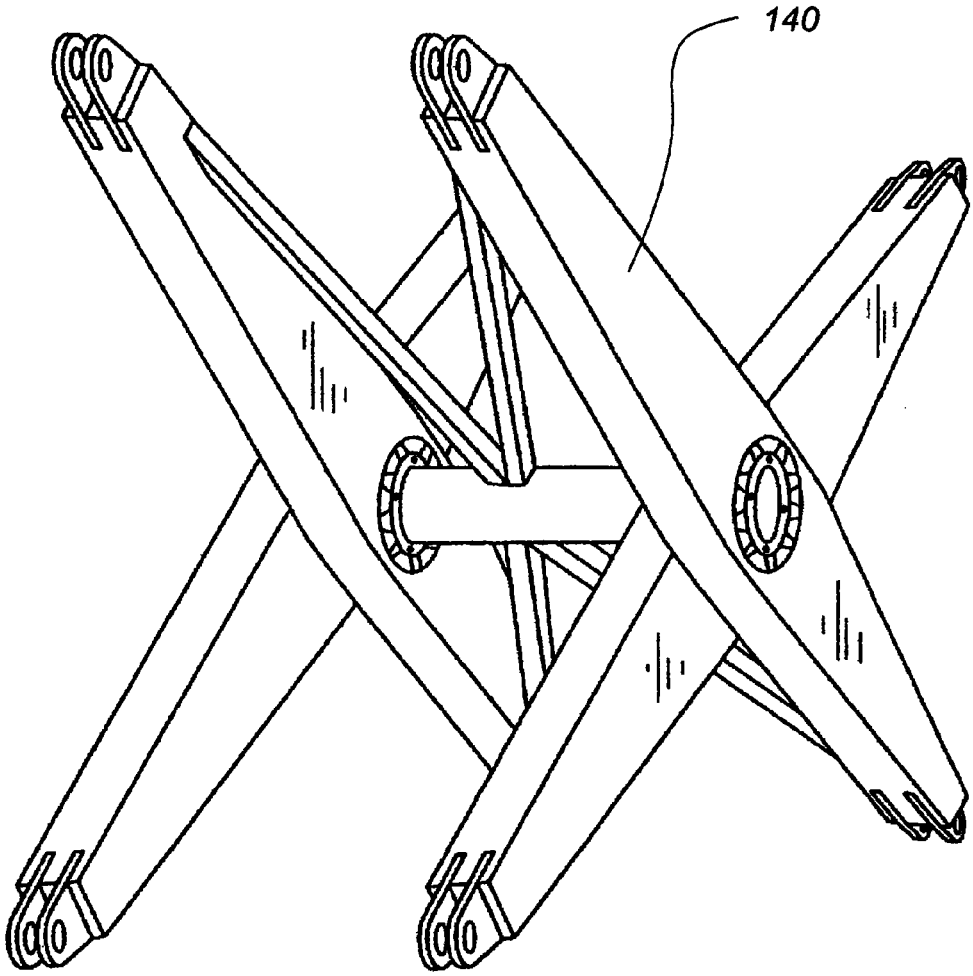
FIG. 28 depicts a perspective view of an opened scissor jack.

Returning to FIG. 3, the process for moving the mast 112 and rig floor 114 onto the trailer 124 will be further described. When the trailer 124 is placed in its extended position and properly aligned with the oil rig substructure 104, it may be attached thereto. Further, the free ends of the scissor jacks 140 are typically pinned in place on the bottom and, optionally, top frames 136, 138. Pinning the scissor jacks places the load of the oil rig and mast on the jacks, rather than the hydraulic cylinders 142, once the top portion is loaded onto the trailer. Typically, one end of each member of the scissor jacks 140 is pinned at all times. FIG. 24, for example, depicts side links 162 for use at the free end of the scissor jacks. The side links receive a positioning pin into a hole 164 to hold the scissor jack 140 in place. FIG. 25 depicts a pin 166 extending through the positioning holes 168 in the rail 170 for the left scissor jack 140 free end (partially shown). The pin extends from one side of the rail 170 to the other. The rails generally define a track 172 along which a scissor jack 140 may move. For reference, FIG. 27 depicts a scissor jack 140 in a collapsed position, while FIG. 28 depicts a scissor jack 140 in an extended position.

Generally, the opposite ends of each separate jack 140 member, located vertically over one another, are pinned. By contrast, the jack's 140 opposing ends are free to move during raising and lowering, which allows the top 138 and bottom 136 frame members of the trailer 124 to stay relatively in position with one another (i.e., with the upper frame aligned directly over the lower frame). However, while the scissor jacks 140 provide structural rigidity to help ensure the load may be carried during mounting of the rig floor 112 and mast 114 on the trailer 124, the hydraulic cylinders 142 are generally sufficiently robust to withstand this load as needed. Accordingly, the scissor jacks 140 provide extra security and are not necessarily needed during the operations described herein.

Still referring to FIG. 3 and also with reference to FIG. 22, there is at least one I-beam 174 on the top surface of the trailer 124 to match with a corresponding rail 116 formed on the top of the substructure 104. The I-beam 174 and rail 116 help guide the rig floor 112 and mast 114 properly onto the trailer 124. The guide beam 174 extends along at least one side of the top of the trailer 124 to properly position the rig floor and mast as it is moved on to the top frame 138 of the trailer. Effectively, the rig floor moves along the rail 116 and I-beam 174 when transitioning from the substructure 104 to the trailer 124, ensuring the rig floor and mast are properly aligned on the trailer for transport. Generally speaking, the distance between the terminus of the rail 116 and the edge of the substructure 104 mated to the trailer 124 is slightly less than the length of the rig floor 112. Accordingly, the rig floor will travel this distance and contact the trailer I-beam 174 before the rig floor completely leaves the rail. In this manner, at least one of the rail 116 and I-beam 174 may guide the movement of the rig floor 112 and mast 114 from the substructure 104 to the trailer 124 at any time the top portion 150 is in motion. In alternate embodiments, the rail may be of a shorter length.

FIG. 4 depicts the rig floor 112 and mast 114 placed on the top surface 138 of the trailer 124, with the scissor jacks 140 extended and locked in place and the hydraulic pistons 142 extended. Here, the previously free ends of the scissor jacks, as shown in FIG. 3, are fixed by pinning. At this point, the trailer 124 is ready to convert to the collapsed position. The trailer must be disengaged from the substructure 104 prior to collapsing. This is done by unpinning the scissor jack 140 legs, then lowering the top frame 138 of the trailer to disengage the aforementioned beam guide 158 and conical member 156 from the undersurface of the substructure 104. In alternate embodiments, the conical member 156 and beam guide 158 may be placed on the substructure 104 and mate with corresponding surfaces on the underside of the trailer's top frame 136, thus necessitating raising the trailer 124 to disengage the substructure 104.

Once disengaged, the substructure 104 and trailer 124 may be moved away from one another. Typically, the substructure 104 is moved away from the trailer 124, leaving the trailer resting on the ground.

At some point after the rig floor 112 and mast 114 are moved onto the trailer 124, they are typically attached to the trailer, either by pinning thereto or another mechanism such as clamping, in order to keep the rig floor and mast securely fastened to the top surface 138 of the trailer.

FIG. 5 shows the trailer 124 in the collapsed position, with the top portion 150 of the rig (i.e., rig floor 112 and mast 114) positioned thereon. As also shown, the trailer is detached from the truck 132 and jeeps 134 at this point. To collapse the trailer 124, the scissor jacks 140 are initially unpinned and the hydraulic pistons 142 are actuated. The pistons lower the top frame 138 towards the bottom frame 136, which in turn collapses the scissor jacks and thus the trailer. Since each scissor jack 140 has its own track 172 permitting free movement of the un-pinned ends, as shown in more detail in FIG. 25, each scissor jack can collapse to its retracted position without interfering with the other scissor jacks.

Once the hydraulic pistons 142 have lowered the top frame 138 toward the bottom frame 136 and the trailer 124 is in the collapsed position, the top and bottom frames may be attached by pinning the holding columns (discussed below) at each corner together. Alternate embodiments may clamp the top 138 and bottom 136 frames to one another, or use other methods to secure the frames. FIG. 30 depicts the top surface 138 of the trailer 124, specifically showing the holding columns 176 projecting downwardly therefrom, as well as the aforementioned scissor jacks 140 and hydraulic pistons 142.

Figure 8:
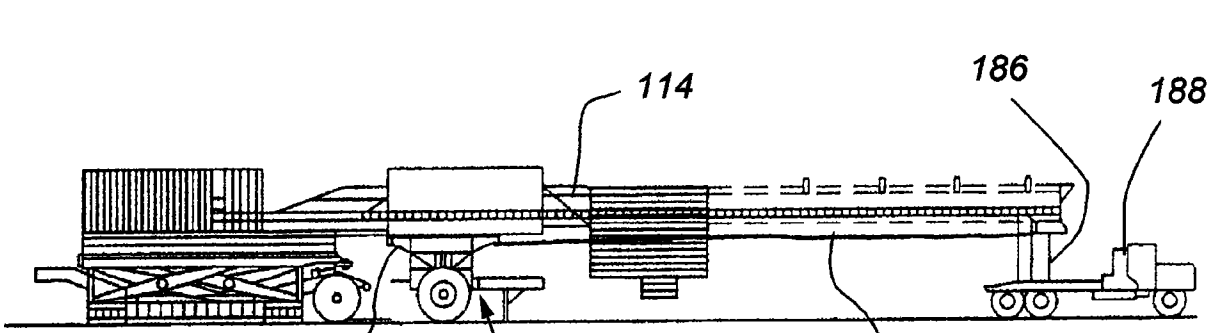
FIG. 8 depicts a side view of the mast dolly of FIG. 7, with the mast parallel to the ground and resting on the mast dolly and a mast support.
Figure 26:
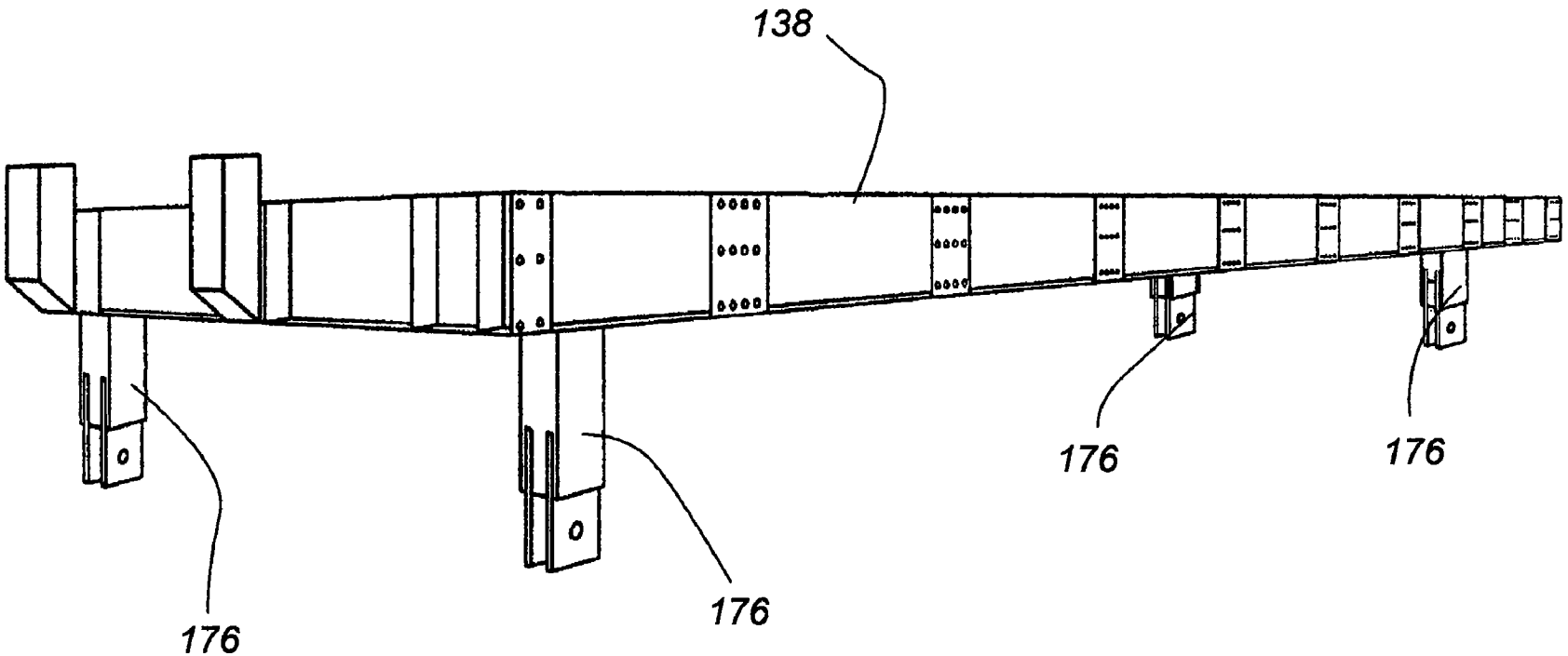
FIG. 26 depicts a perspective view of the top surface of the trailer of FIG. 1.

In the present embodiment and as shown in FIGS. 8 and 30, a holding column 176 extends upwardly from each corner of the bottom frame 136 and a corresponding column 176 extends downwardly from each corner of the top frame 138. In some embodiments, the columns 176 may be positioned near the corners, in the middle of each frame edge, anord so forth. Regardless of the exact positioning of the columns 176 with reference to the top 138 and bottom 136 frames, the ends of corresponding columns are pinned together when the trailer 124 is in the collapsed position to minimize load carried by the hydraulic pistons 142. The pinned (or otherwise attached) columns 176 further provide additional structural rigidity to the trailer, thus facilitating towing the trailer 124 behind a vehicle 132 or vehicles and minimizing swaying, tipping, or bending that might otherwise occur during towing. The aforementioned columns 176 are depicted in FIG. 4 in an unattached state, and are shown pinned together in FIG. 5. The columns 176 are also depicted in FIG. 26.

Once lowered, feet 154 are extended to push the trailer up off the ground a sufficient distance to allow the rear wheels 144 to be pivoted from their retracted position (shown in FIG. 4) to a weight-supporting and transport position (shown in FIG. 5). The wheel frame or arm 178 is fixed in this position by a removable pin or another such structure. While the feet 154 are extended, the front jeeps 134 are typically positioned on the trailer 124 end opposite the feet and the wheels 144. In this manner, the wheels may accept the trailer weight when the feet are retracted and the trailer is transported by truck 132. The jeeps 134 are typically placed on the trailer 124 with a truck or a forklift. Where a forklift is used to place the jeeps 134, a truck or other towing vehicle must also be connected to the jeep end opposite the trailer.

Figure 6:
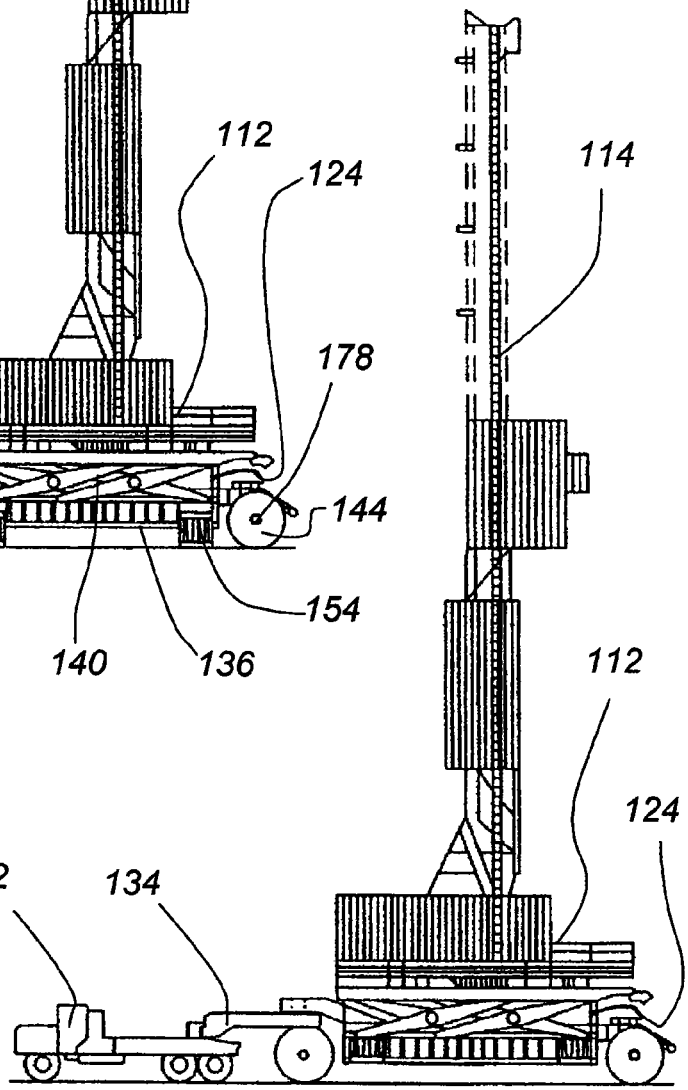
FIG. 6 depicts the trailer and truck of FIG. 1 interconnected by a jeep, with the rig floor and mast positioned on the trailer.

Once the jeeps 134 connect the trailer 124 to a truck 132 or other vehicle, the rig floor 112 and upright mast 114 are ready for transport to a new location. FIG. 6 depicts the trailer 124 and truck 132 interconnected by a jeep 134, with the rig floor 112 and mast 114 positioned on the trailer. The substructure 104 may be moved under its own power separate from the rig floor and mast, as previously mentioned.

Separate Transport of the Rig Floor and Mast

Hauling the rig floor 112 with the mast 114 in the upright position is often sufficient to move the rig floor and mast to a new location. However, when more severe grades and more difficult terrain must be traveled over, it may be beneficial to move the mast 114 separately from the rig floor 112. FIGS. 7, 8, 9, 10 and 11 generally depict this process.

Figure 7:
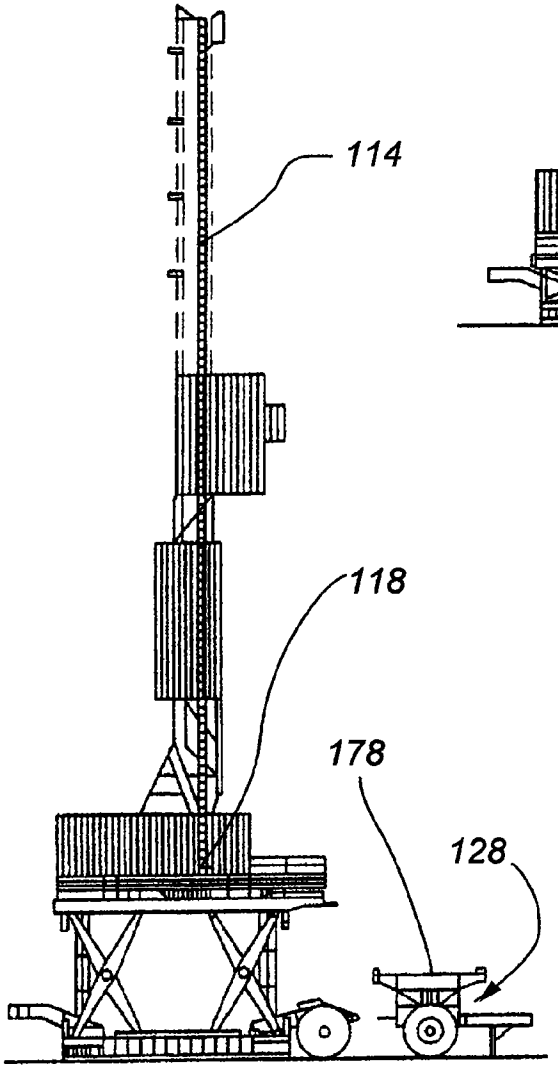
FIG. 7 depicts a side view of an mast dolly for transporting an oil rig mast.

Beginning with FIG. 7, a mast dolly 128 is positioned near the rear end of the trailer 124 (i.e., the end furthest from the truck 132 used to tow the rig floor 112). The mast dolly 128 generally takes the form of a trailer 178 with a set of wheels 180 and an adjustable-height support framework 182, similar to that described above with reference to FIGS. 1-6 and shown in more detail with reference to FIGS. 16-19. The mast dolly may include a front support 184 designed to stabilize the dolly and keep it level during the mast loading process. A mast dolly kingpin 130 (shown to better effect in FIG. 20) may assist in stabilization and height adjustment of the dolly 128. Typically, the front support 182 is height-adjustable.

In the present embodiment 100 and returning to FIG. 7, the height of the framework 182 may be adjusted by hydraulic pistons. Alternate embodiments may use various means known in the art to adjust the framework 182 height, such as pneumatic cylinders, telescoping supports, a rigid frame supporting the framework and having multiple heights at which the framework may be pinned or supported, and so on.

Continuing with FIG. 7, draw works (not shown) on the rig floor 112 are activated. These draw works include cables, pulleys, hoists, motors and other equipment. The mast 114 is disconnected sufficiently so that its base pivots about a front kingpin 118 in order for the mast 114 to be tipped over away from the end of the trailer 124 where the jeeps 134 are typically positioned. If the mast 114 is hauled separately, the step of disconnecting the mast from the rig floor 112 is typically (but not necessarily) performed while the trailer 124 is resting on the ground, before the feet 154 are extended, and before the wheels 144 are repositioned to support the trailer.

The dolly trailer 178 is collapsed to its lower position before the mast 114 is lowered in a controlled manner by the draw works. In the present embodiment, while being lowered, the mast 114 pivots about the kingpin 130 to about a ninety degree angle from its upright position. The support structure 182 on the mast dolly 128 may raise to support the base of the lowered mast, as shown in FIG. 8. The top of the mast 114 is typically supported on a mast support 186, which in turn may be mounted on a truck 188. The top of the mast 114 is positioned on the mast support by a hitch (for example, a fifth wheel hitch) positioned on the support 186.

The support typically takes the form of a post or short tower framework extending upwardly from the truck. The framework 186 is adjustable such that its height may vary as needed. In alternate embodiments, the support 186 may be separate from the truck. For example, the framework may take the form of a separate post positioned adjacent to the truck.

Still with respect to FIG. 8, a support brace 190 may extend between the truck 188 and the mast dolly 128 to provide additional structural rigidity, if needed. However, it should be noted that the support brace 190 is not necessary, insofar as the mast 114 itself provides sufficient structural integrity to permit the truck to tow the dolly. Effectively, the mast 114 acts as a "trailer" linking the truck 188 and mast dolly 128, and is generally capable of withstanding forces exerted along the body during the towing process without bending, warping, or snapping.

Prior to towing, the base of the mast 114 is disconnected from the rig floor 112. The mast 114 base may be attached to the mast dolly 128 using links, pins or another affixing structure or structures. The height of the support structure 182 on the mast dolly 128 and the height of the mast support 186 on the truck 188 may be adjusted as necessary to securely trailer the mast 114. These height adjustments may be fixed in a variety of positions by structural connections on both the mast dolly 128 and support 186, in order to relieve at least a portion of load from the hydraulic pistons.

Figure 9:
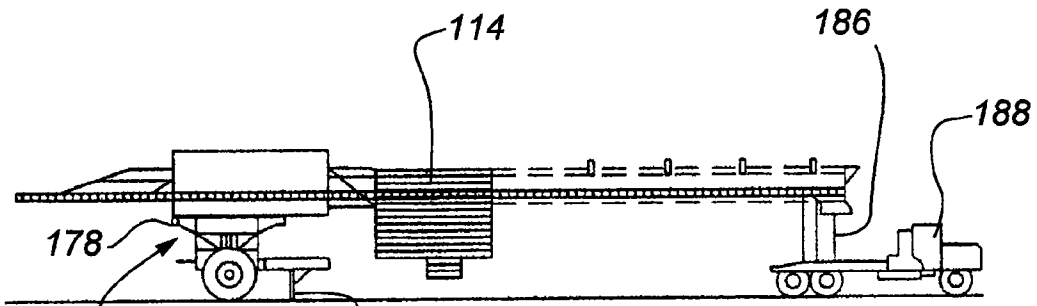
FIG. 9 depicts a side view of the mast dolly of FIG. 7 and mast support of FIG. 8, with the mast supported thereby and prepared for transport.

FIG. 9 shows the truck 188, mast dolly 128, and mast 114 ready for transport. The mast dolly front support 184 may remain extended or can be retracted, depending on the terrain to be traversed.

Figure 10:
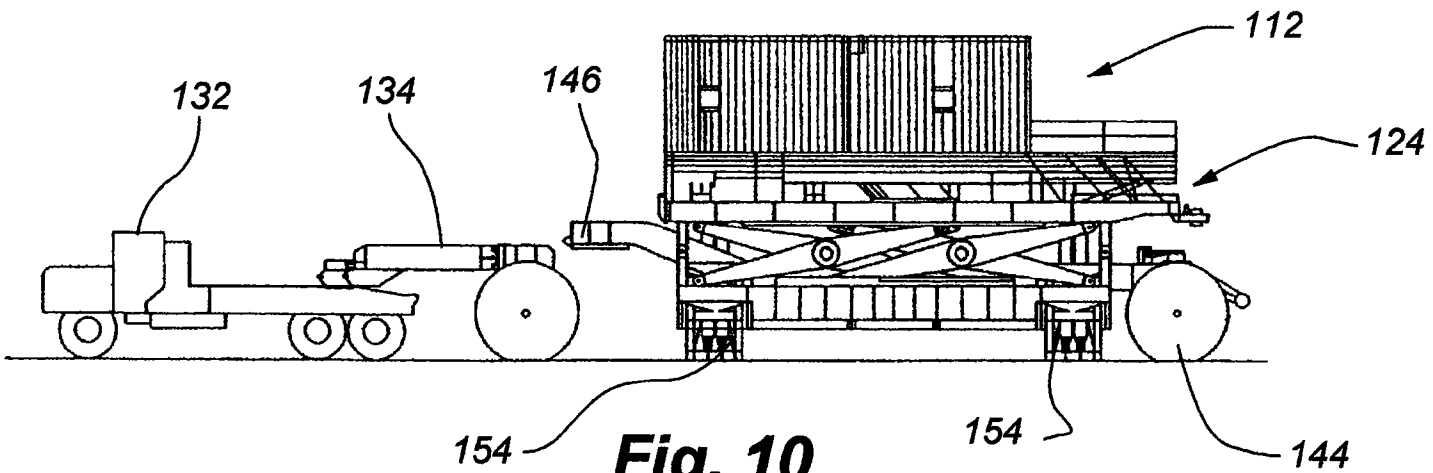
FIG. 10 depicts a side view of the trailer of FIG. 1 carrying a rig floor, with the trailer in a collapsed position.
Figure 11:
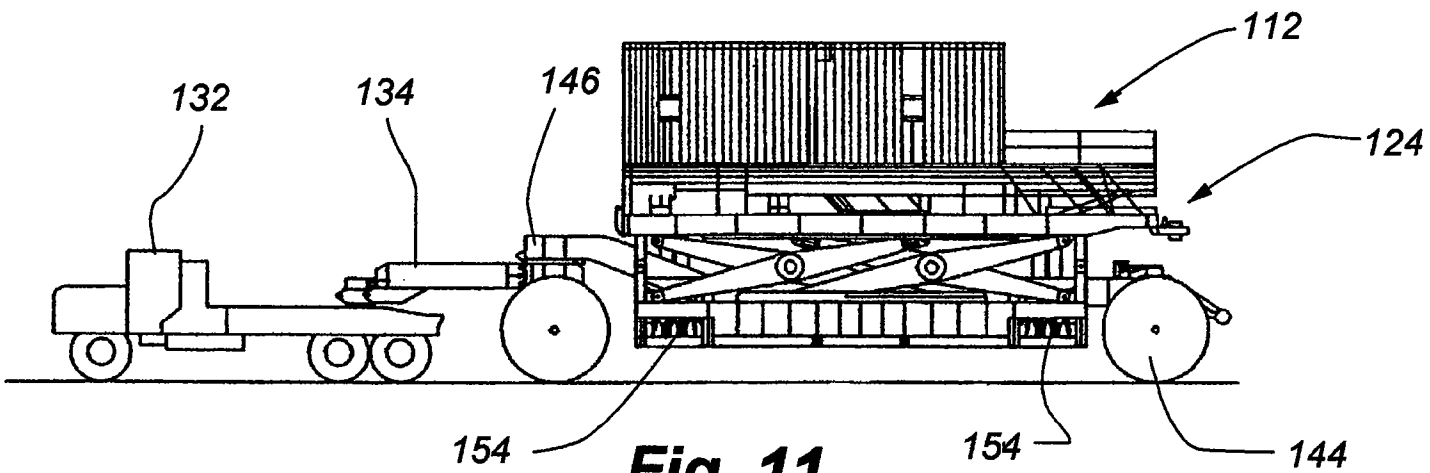
FIG. 11 depicts a side view of the trailer of FIGS. 1 and 10 attached to a truck via a jeep.

FIGS. 10 and 11 show the trailer 124 carrying the rig floor 112 without the mast 114. In FIG. 10, the trailer 124 is supported up off the ground on the feet 154 or bearing pads (actuated by hydraulic cylinders or the like), and the jeeps 134 are positioned on the trailer. The jeeps are positioned one at a time. It should be noted that FIGS. 10 and 11 depict a single jeep 134, insofar as the second (and potentially third or fourth) jeep is obscured in the figures' side view. Prior to or at the same time as attaching the jeep(s) 134 (either by truck or forklift, as previously mentioned), the rear wheels 144 are positioned in place, as discussed above. Once the gooseneck 146 of the trailer 124 is attached to the respective jeep 132 and the feet are retracted, the trailer is ready for transport by a tow vehicle. FIG. 11 depicts the trailer attached to the jeep by the gooseneck 146, with the wheels 144 in position and feet 154 retracted.

There are several bearing pads (i.e., feet 154) on the trailer 124. The present embodiment uses at least three bearing pads, although alternate embodiments may employ more of fewer pads. The bearing pads are typically attached to the lower frame 136 and actuated by hydraulic cylinders to extend and retract as needed. In one embodiment, the bearing pads may be manufactured from nylatron. In alternate embodiments (such as the embodiment employing a trailer 124 with weight-transferring hydraulic pistons, described below in the section entitled "Trailer Loading Hydraulics,"), the bearing pads may be manufactured from steel. Alternate embodiments may employ any material capable of withstanding the loading stresses typically placed on the bearing pads during operation.

The Trailer

Figure 12:
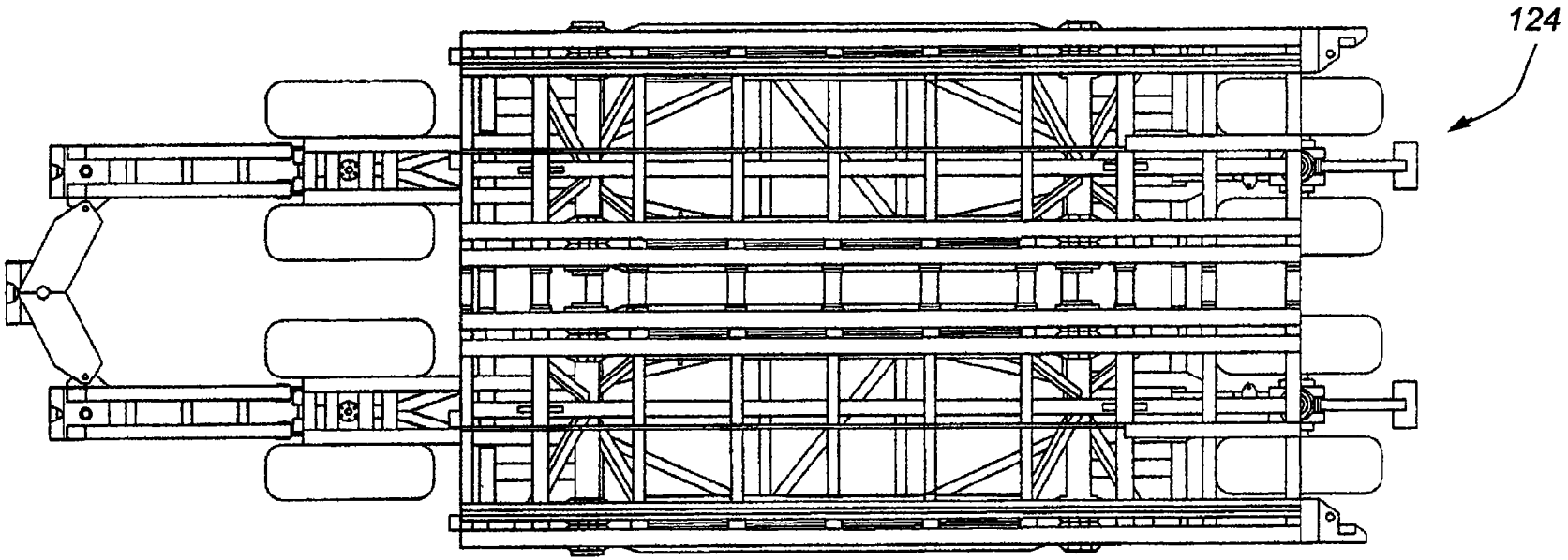
FIG. 12 depicts a plan view of the trailer of FIGS. 1, 10, and 11.
Figure 13:
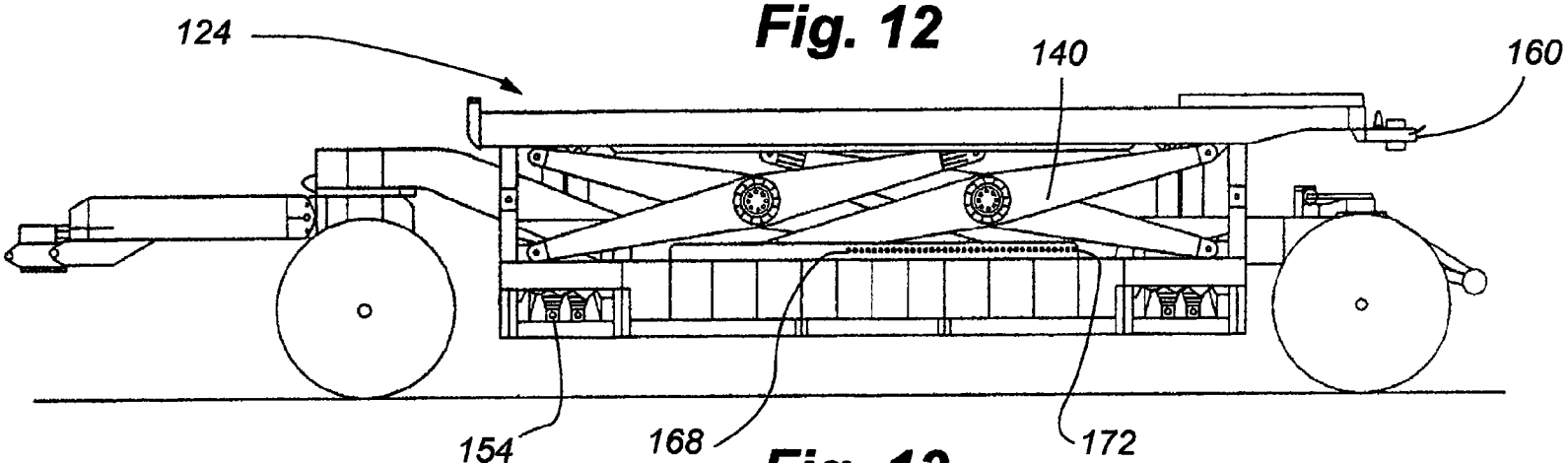
FIG. 13 depicts a side view of the trailer of FIGS. 1, 10, 11, and 12.

FIGS. 12 and 13 depict a top and side view, respectively, of the trailer 124 used to transport the top portion 150 of the oil rig 102. FIG. 12 is a plan view of the trailer 124 in the collapsed position. FIG. 13 is a side view of the trailer in the collapsed position. FIG. 13 also depicts a series of holes 168 on the side of the track 172. As previously mentioned, the track permits a free end of a scissor jack 140 to move back and forth. These holes 168 permit the scissor jack's 140 free end to be pinned (or otherwise affixed) at a variety of different lateral locations, and thus at different heights. Other means of temporarily fixing the jack end can be used, such as blocks or other structures. Each free end may assume a variety of positions. In the present embodiment, only the lower free end need be fixed to create a rigid structure. In some embodiments, the upper free end may be pinned in addition to, or instead of, the lower free end. For example, the upper free end may also be pinned to provide maximum rigidity to the scissor jack 140.

Figure 15:
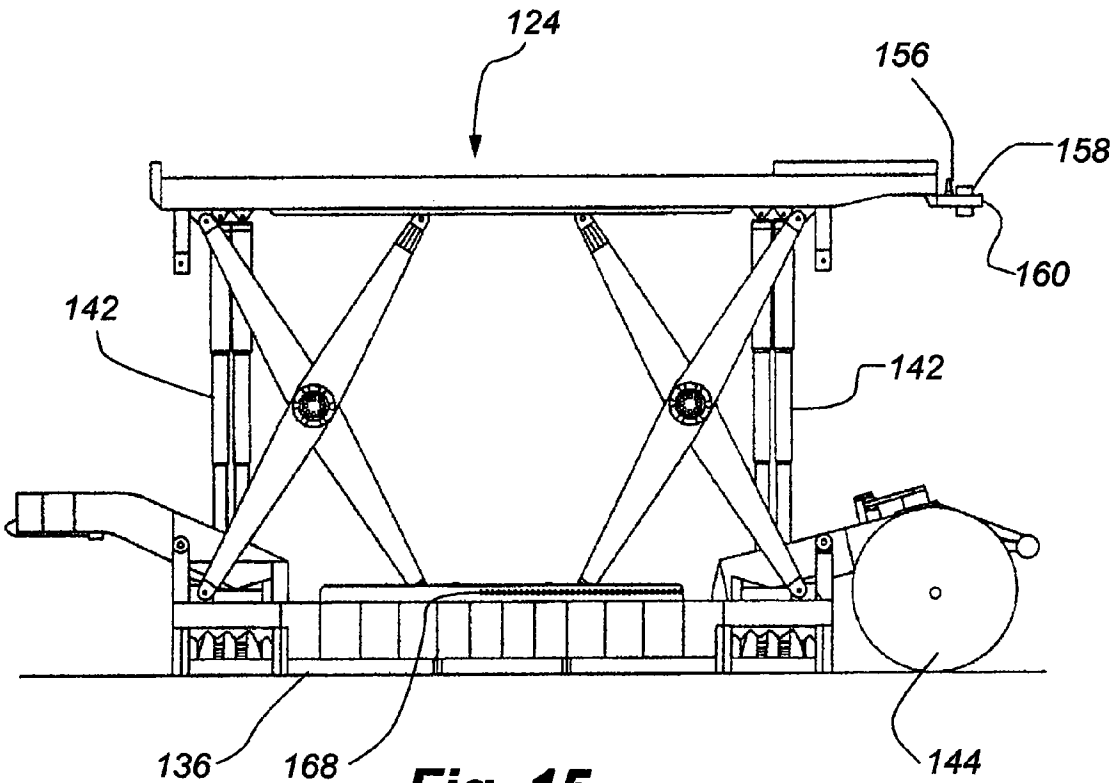
FIG. 15 depicts a side view of the trailer of FIG. 14.
Figure 14:
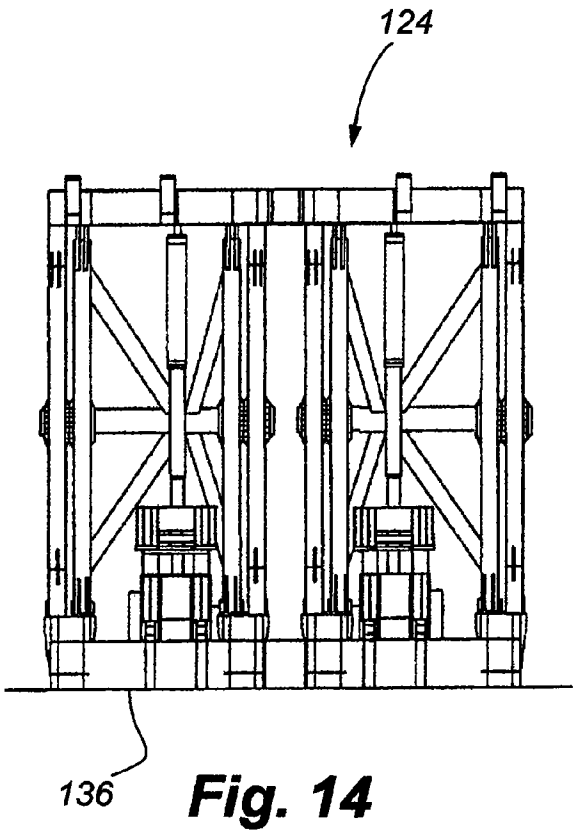
FIG. 14 depicts an end view of the trailer of FIGS. 1, 10, 11, 12, and 13 in the extended position, with the lower frame resting on the ground.

FIG. 14 depicts an end view of the trailer 124 in the extended position, with the lower frame 136 resting on the ground. FIG. 15 depicts a side view of the trailer 124 in the extended position. Also seen in FIG. 15 are the holes 168 for pinning the scissor jack in place. Note that the trailer 124 could extend further, by moving the free end of the scissor jack 140 along the row of holes 168 (i.e., toward the fixed end of the scissor jack.) In the view shown in FIG. 15, the trailer's rear wheels 144 are disconnected and tilted up to allow the lower frame 136 to rest on the ground. The two front and two rear hydraulic pistons 182 are shown at least partially extended. The alignment structures (i.e., conical member 156 and beam guide 158) for the engagement with the substructure 104 are also depicted.

It should be noted that the trailer 124 and associated structure are fabricated from available structural materials or fabricated structural elements sufficient to handle the heavy loads expected to be carried.

The Mast Dolly

Figure 17:
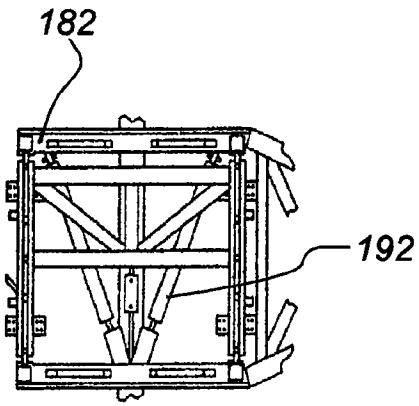
FIG. 17 depicts a cross-sectional view of the mast dolly of FIG. 16.
Figure 16:
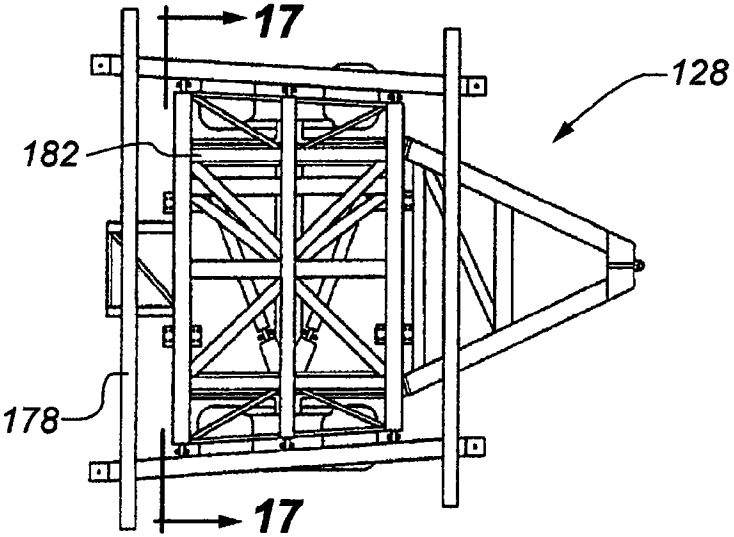
FIG. 16 depicts a plan view of a mast dolly.
Figure 19:
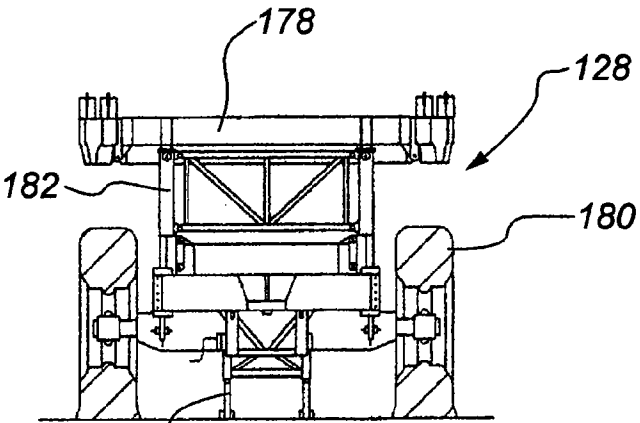
FIG. 19 depicts a second cross-sectional view of the mast dolly of FIG. 16.
Figure 18:
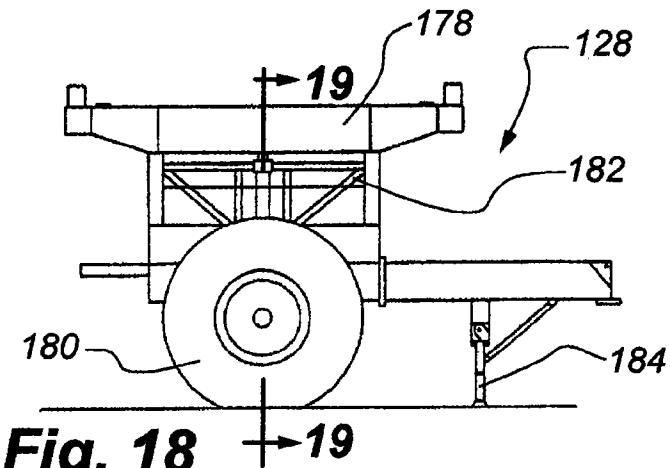
FIG. 18 depicts a side view of the mast dolly of FIG. 16.

FIGS. 16, 17, 18 and 19 show the mast dolly 128 from various views. FIG. 16 depicts a plan view of the mast dolly 128, while FIG. 18 depicts a side view. FIG. 17 is a cross-section view taken along line 17-17 of FIG. 16. Similarly, FIG. 18 is a cross-section view taken along line 19-19 of FIG. 18. The support 184 located at the front of the mast dolly 128 can be left down, or retracted all the way or partially, as needed. Typically, the support 184 is at least partially retracted during transit.

As shown in FIG. 16, the top of the trailer 178 of the mast dolly 128 need not be a solid surface. Instead, the trailer 178 may be constructed from a framework sufficient to support the mast 114 top. Generally, the support structure 182 braces the trailer 178, and may raise or lower the trailer as needed to adequately support the mast 114 top during towing. The hydraulic pistons 192 facilitating raising and lowering of the support structure 182 are shown to better effect in FIG. 17.

As shown in FIG. 16, the top of the trailer 178 of the mast dolly 128 need not be a solid surface. Instead, the trailer 178 may be constructed from a framework sufficient to support the mast 114 top. Generally, the support structure 182 braces the trailer 178, and may raise or lower the trailer as needed to adequately support the mast 114 top during towing. The hydraulic pistons 192 facilitating raising and lowering of the support structure 182 are shown to better effect in FIG. 17.

Figure 21:
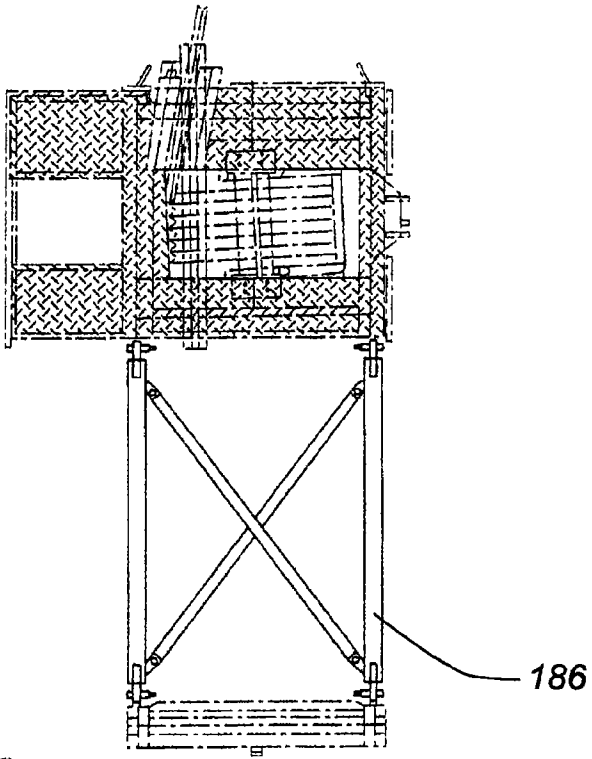
FIG. 21 depicts a view of the mast support of FIG. 20.

FIG. 20 shows the mast dolly kingpin 130 in a side view, as well as its relation to the mast dolly support 186. For reference, portions of the mast truck 188, mast support 186, and mast 114, are shown in phantom. In the view of FIG. 20, the mast support 186 is mounted on a truck 188, as is the mast dolly kingpin 130. FIG. 21 shows the mast dolly support 186 for supporting the top of the mast in an end view.

Trailer Loading Hydraulics

Generally, the trailer 124 supports a majority of the weight of the oil rig's 112 top portion 150. Accordingly, the truck 132 (or other vehicle) may lack sufficient traction on certain surfaces, such as ice or snow, to haul the trailer 124.

Figure 31:
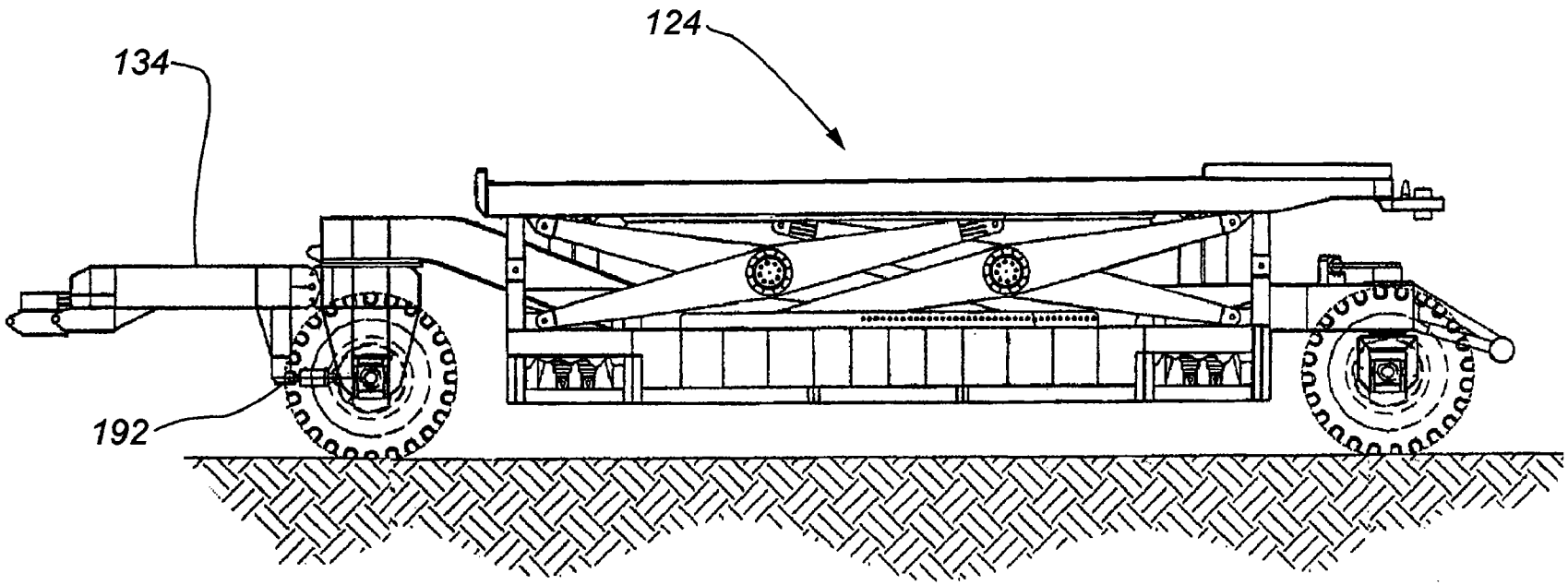
FIG. 31 depicts a side view of a trailer and jeep incorporating a load transfer device.
Figure 32:
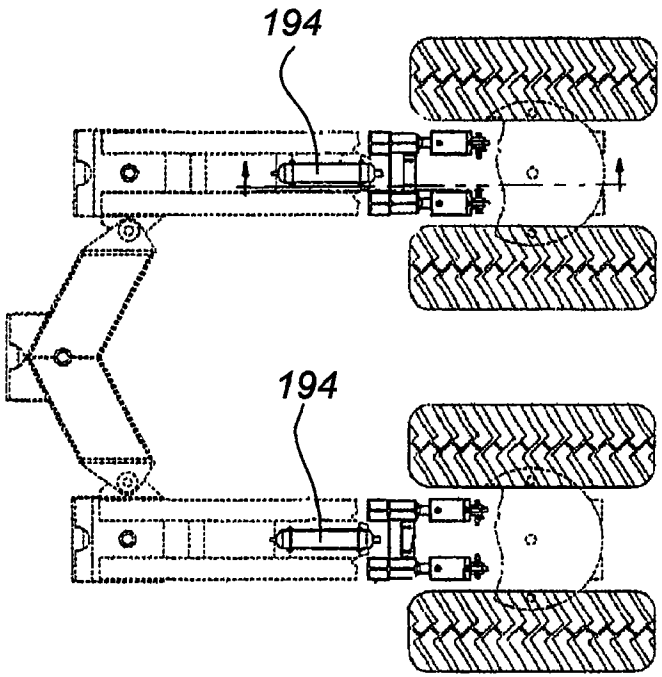
FIG. 32 depicts a plan view of a jeep incorporating the load transfer of FIG. 31.
Figure 33:
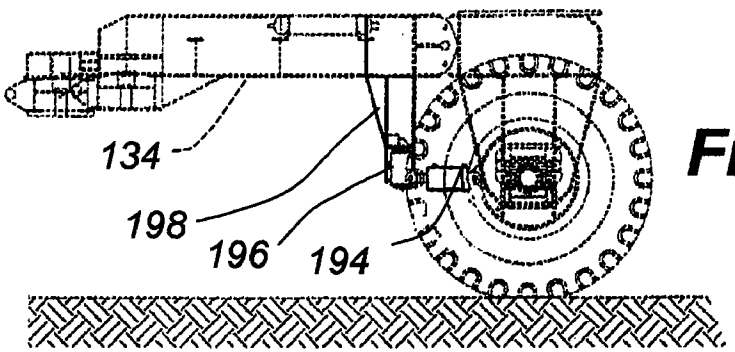
FIG. 33 depicts a side view of a jeep incorporating the load transfer of FIG. 31.
Figure 35:
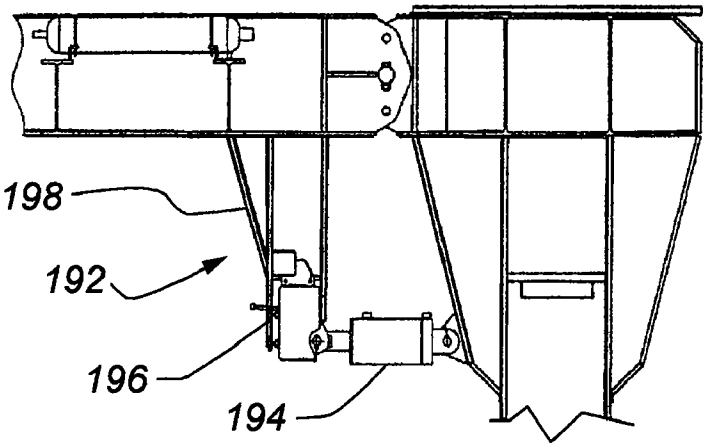
FIG. 35 depicts a cross-sectional view of the jeep of FIGS. 27-29, taken along line A-A of FIG. 27.
Figure 34:
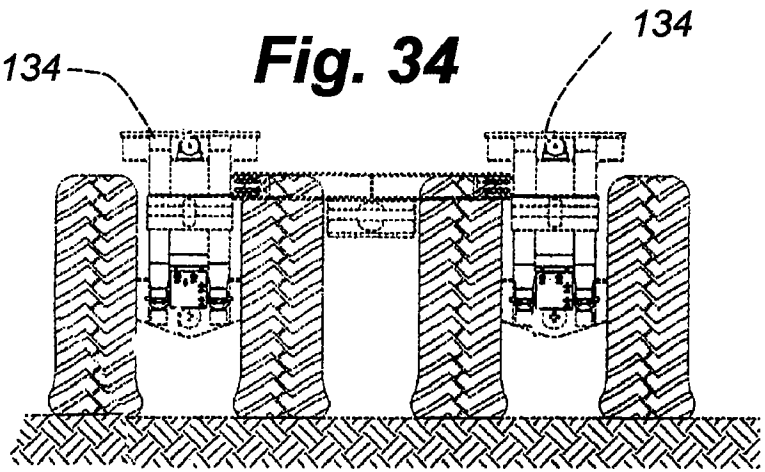
FIG. 34 depicts an end view of a jeep incorporating the load transfer of FIG. 31.

One embodiment of the present invention 100 employs a load transfer device 192 to alleviate this problem. Generally, the load transfer device 192 may be added to the jeep 134 to shift a greater portion of the trailer 124 load from the jeep to the truck 132. FIG. 31 depicts a side view of the trailer 124 affixed to the jeep 134, showing the load transfer device 192 on the jeep. In order to accurately depict the load transfer device 192, the jeep 134 wheels are depicted in transparent view to show the load transfer device positioning. FIGS. 32, 33, and 34 depict plan, side, and end views of the jeep 134 and load transfer device 192, respectively. FIG. 35 depicts a cross-sectional view of the load transfer device taken along line A-A of FIG. 32.

The load transfer device 192 generally exerts force forward, toward the truck 132 and away from the jeep 134 wheels 148, via one or more load transfer cylinders 194. A load transfer control panel 196 assembly typically controls operation of the load transfer cylinders 194, and may permit varying degrees of load to be shifted to the truck 132. Finally, a load transfer bar 196 transmits the force exerted by the load transfer cylinder 194 to the truck. In some embodiments, the control panel 194 and/or transfer bar 196 may be omitted.

CONCLUSION

In sum, various embodiments of the invention include not only the trailer structure, but also includes the method of using the trailer, the combination of the trailer and mast dolly(s), the method of using the combination of the trailer and the mast dolly(s), the separable oil rig, the method for transporting top and bottom portions of the rig separately, and so forth.

The method may include the acts of raising the top frame of the trailer to an extended position at a height of the top of the substructure, moving the rig floor and at least a portion of the mast (or, in some embodiments, solely the rig floor) onto the trailer, and lowering the top frame of the trailer to a collapsed position. The method may also include intermediate acts including securing the scissor jacks, securing the rig floor to the top frame, securing the top and lower frame together when in the collapsed position, and preliminary acts of resting the trailer frame on the ground and following acts such as raising the trailer frame off the ground onto wheels for transport. The method generally also includes the act of transporting the rig floor and mast separately from the substructure. The method generally also includes the act transporting the rig floor, mast, and substructure separately from one another.

As will be recognized by those skilled in the art from the foregoing description of exemplary embodiments of the invention, numerous variations on the described embodiments may be made without departing from the spirit and scope of the invention. For example, treads may be used in place of wheels to provide smoother transportation over sandy surfaces, the oil rig maybe broken down into three or more sections instead of two, or towing trucks may be omitted and the rig floor trailer provided with integral locomotive means. Further, while the present invention has been described in the context of specific embodiments and transport methods, such descriptions are by way of example and not limitation. Accordingly, the proper scope of the present invention is specified by the following claims and not by the preceding examples.

We claim:

1. A trailer for moving a part of an oil rig along a support surface, said trailer comprising:

a bottom frame;

a top frame;

a structure operably associated with said bottom and top frames for moving said top and bottom frames away from and towards one another and further operative to temporarily fix the position of said top and bottom frames with respect to one another, the structure comprising at least one hydraulic piston;

an alignment mechanism affixed to one of said top and bottom frame, the alignment mechanism operative to align said top frame with a top surface of said oil rig;

an I-beam affixed to said top surface and operative to facilitate loading said part of said oil rig onto said trailer; and a moving means attached to at least said bottom frame to allow the trailer to be moved along the support surface.

2. The trailer of claim 1, wherein said moving means comprises at least one wheel.

3. The trailer of claim 1, wherein said moving means comprises a skid surface.

4. The trailer of claim 1, wherein said moving means comprises at least one track.

5. The trailer of claim 1, further comprising a jeep operative to connect said bottom frame to a vehicle.

6. The trailer of claim 1, wherein said moving means includes at least one railroad wheel for use on a railroad track.

7. The trailer of claim 1 wherein the structure further comprises at least one scissors jack.

8. A trailer for moving a part of an oil rig along a support surface, said trailer comprising:

a bottom frame;

a top frame;

a structure operably associated with said bottom and top frames for moving said top and bottom frames away from and towards one another and further operative to temporarily fix the position of said top and bottom frames with respect to one another, the structure comprising at least one hydraulic piston;

an alignment mechanism affixed to one of said top and bottom frame, the alignment mechanism operative to align said top frame with a top surface of said oil rig;

said alignment mechanism comprising:

an extension;

a conical member extending from said extension; and a beam guide extending from said and a moving means attached to at least said bottom frame to allow the trailer to be moved along the support surface.

9. The trailer of claim 8, wherein the structure further comprises at least one scissors jack.

10. A trailer system for moving an oil rig mast having an interconnected base, body, and top, said trailer system comprising:

a mast dolly for supporting said base of said oil rig mast;

a mast support for supporting said top of said oil rig mast;

a support connecting said mast support to said mast dolly; and the mast dolly comprises:

a trailer upon which said base of said oil rig mast rests;

a height-adjustable support framework operably connected to said trailer;

a moving means attached to said support framework; and a retractable front support attached to said height-adjustable support.

11. The trailer system of claim 10, wherein said support comprises said body of said oil rig mast.

12. A method of moving at least part of an oil rig, the oil rig comprising at least a substructure, a must and rig floor, said method comprising:

moving at least said rig floor onto a trailer from said substructure;

moving said trailer carrying at least said rig floor;

moving said substructure separately from said trailer;

moving said mast to a mast dolly;

moving said trailer carrying said rig floor; and moving said mast dolly carrying said mast separately from said substructure and said trailer.

13. A method for transporting an oil rig, comprising:

disassembling the oil rig to form a top portion comprising a rig floor and a mast and bottom portion comprising a substructure;

transporting the top portion separately from the bottom portion;

transporting said rig floor on a trailer;

raising a top surface of said trailer to accept said rig floor; and prior to said step of transporting said rig floor on said trailer, lowering said top surface of said trailer.

14. The method of claim 13, further comprising:

moving said rig floor and mast from atop said substructure onto said trailer;

attaching said trailer to a vehicle by at least one jeep: and moving said substructure under its own power; and wherein said step of transporting said rig floor and mast on a trailer comprises hauling the rig floor and mast placed on said trailer by said vehicle.

15. The method of claim 13, further comprising:

disconnecting said mast from said rig floor;

pivoting said mast about a kingpin by means of a draw works;

loading said mast at least partially on a mast dolly;

further loading said mast at least partially on a mast support; and transporting said mast separately from said rig floor.

16. A method for transporting an oil rig, comprising:

disassembling the oil rig to form a top portion comprising a rig floor and a mast and bottom portion comprising a substructure;

transporting the top portion separately from the bottom portion;

transporting said rig floor on a trailer;

disconnecting said mast from said rig floor;

pivoting said mast about a kingpin by means of a draw works;

loading said mast at least partially on a mast dolly;

further loading said mast at least partially on a mast support;

transporting said mast separately from said rig floor;

attaching said trailer to a jeep with a gooseneck;

attaching said jeep to a vehicle; and wherein said step of transporting said rig floor on a trailer comprises hauling said trailer with said vehicle.

17. The method of claim 16, further comprising exerting a traction force on said vehicle by means of a load transfer mechanism attached to said jeep.

18. The trailer of claim 8, wherein said moving means comprises at least one wheel.

19. The trailer of claim 8, wherein said moving means comprises a skid surface.

20. The trailer of claim 8, wherein said moving means comprises at least one track.

21. The trailer of claim 8, further comprising a jeep operative to connect said bottom frame to a vehicle.

22. The trailer of claim 8, wherein said moving means includes at least one railroad wheel for use on a railroad track.

23. The trailer of claim 16, further comprising moving said substructure under its own power.

* * * * *